US009382090B2

(12) United States Patent
Kaida

(10) Patent No.: US 9,382,090 B2
(45) Date of Patent: Jul. 5, 2016

(54) IMAGE FORMING APPARATUS THAT EJECTS PRINTED SHEETS FROM MULTIPLE TRAYS AT THE SAME TIME

(71) Applicant: CANON KABUSHIKI KAISHA, Tokyo (JP)

(72) Inventor: Yoshiteru Kaida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/876,462

(22) Filed: Oct. 6, 2015

(65) Prior Publication Data

US 2016/0101959 A1 Apr. 14, 2016

(30) Foreign Application Priority Data

Oct. 8, 2014 (JP) ..... 2014-207331

(51) Int. Cl.

| | |
|---|---|
| ***B65H 31/24*** | (2006.01) |
| ***B65H 29/68*** | (2006.01) |
| ***B65H 29/66*** | (2006.01) |
| ***B65H 31/30*** | (2006.01) |
| ***G03G 15/00*** | (2006.01) |
| ***B65H 39/07*** | (2006.01) |

(52) U.S. Cl.

CPC ..... *B65H 31/24* (2013.01); *B65H 29/6681* (2013.01); *B65H 29/68* (2013.01); *B65H 31/3081* (2013.01); *B65H 39/07* (2013.01); *G03G 15/6538* (2013.01); *B65H 2301/42266* (2013.01); *B65H 2405/332* (2013.01); *B65H 2408/1143* (2013.01); *G03G 2215/00907* (2013.01)

(58) Field of Classification Search

CPC ..... G03G 15/6538; G03G 2215/00907; B65H 31/3081; B65H 2301/42266; B65H 2404/73; B65H 2408/111; B65H 2408/1141; B65H 2408/1142; B65H 2408/1143; B65H 2405/332; B65H 39/07; B65H 31/24

See application file for complete search history.

(56) References Cited

U.S. PATENT DOCUMENTS 5,358,238 A * 10/1994 Mandel ..... B65H 31/24 101/2
9,156,645 B2 * 10/2015 Tsuji ..... B65H 31/3081

FOREIGN PATENT DOCUMENTS

JP 2013-220905 A 10/2013
JP 2014-114164 A 6/2014

* cited by examiner

*Primary Examiner* — Justin Olamit
(74) *Attorney, Agent, or Firm* — Canon USA, Inc. IP Division

(57) ABSTRACT

An image forming apparatus includes a body having an opening, an image forming unit, storage units that can store a sheet, and a moving unit provided in each storage unit. The moving unit moves the stored sheet and then stops it in an exposed state where the sheet is partly exposed, from the opening, to a body outside. Where a first sheet and a second sheet, stored in a storage unit different from where the first sheet is stored, contact and then are exposed to the outside, when a first sheet moving distance to the exposed state and a second sheet moving distance to the exposed state are different, the moving unit changes a first sheet movement start timing relative to that of the second sheet or changes a first sheet moving speed relative to that of the second sheet, based on moving distances of the first and second sheets.

20 Claims, 16 Drawing Sheets

USER B ISSUES DISCHARGE INSTRUCTION

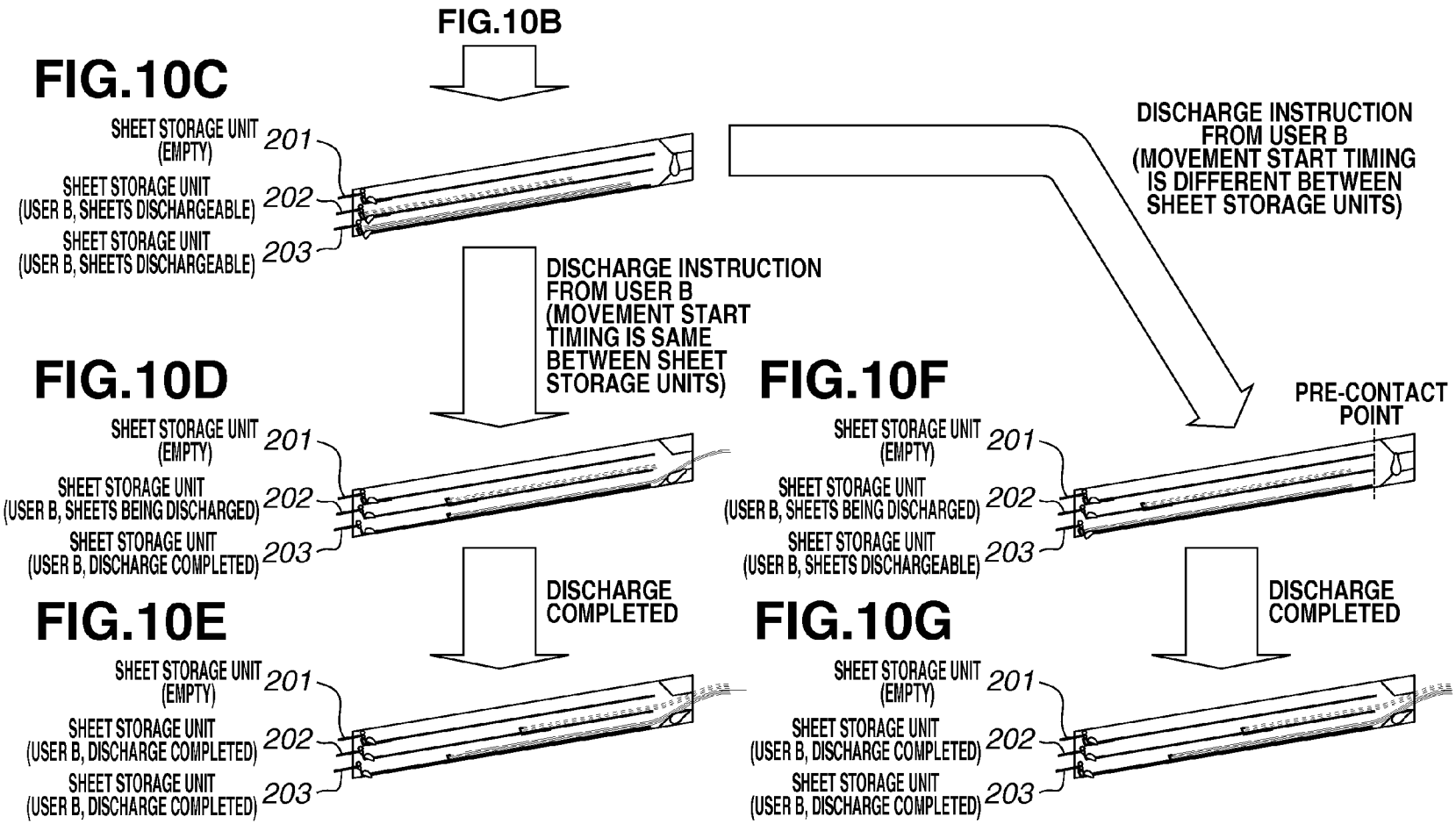
FIG.10B
FIG.10C
SHEET STORAGE UNIT (EMPTY)
SHEET STORAGE UNIT (USER B, SHEETS DISCHARGEABLE)
SHEET STORAGE UNIT (USER B, SHEETS DISCHARGEABLE)
201
202
203
DISCHARGE INSTRUCTION FROM USER B (MOVEMENT START TIMING IS SAME BETWEEN SHEET STORAGE UNITS)
DISCHARGE INSTRUCTION FROM USER B (MOVEMENT START TIMING IS DIFFERENT BETWEEN SHEET STORAGE UNITS)
FIG.10D
SHEET STORAGE UNIT (EMPTY)
SHEET STORAGE UNIT (USER B, SHEETS BEING DISCHARGED)
SHEET STORAGE UNIT (USER B, DISCHARGE COMPLETED)
FIG.10E
SHEET STORAGE UNIT (EMPTY)
SHEET STORAGE UNIT (USER B, DISCHARGE COMPLETED)
SHEET STORAGE UNIT (USER B, DISCHARGE COMPLETED)
DISCHARGE COMPLETED
FIG.10F
PRE-CONTACT POINT
SHEET STORAGE UNIT (EMPTY)
SHEET STORAGE UNIT (USER B, SHEETS BEING DISCHARGED)
SHEET STORAGE UNIT (USER B, SHEETS DISCHARGEABLE)
DISCHARGE COMPLETED
FIG.10G
SHEET STORAGE UNIT (EMPTY)
SHEET STORAGE UNIT (USER B, DISCHARGE COMPLETED)
SHEET STORAGE UNIT (USER B, DISCHARGE COMPLETED)

| REMAINING CONVEYANCE DISTANCE OF SUBSEQUENT SHEET [mm] | THRUST LENGTH [mm] | |
|---|---|---|
| | 5 SHEETS | 1 SHEET |
| 130 | 10 | 5.1 |
| 90 | 6.1 | 3 |
| 50 | 4.8 | 1.2 |

| REMAINING CONVEYANCE DISTANCE OF SUBSEQUENT SHEET [mm] | THRUST LENGTH [mm] | |
|---|---|---|
| | PLAIN PAPER | THIN PAPER |
| 110 | 14 | 16.8 |
| 70 | 5.5 | 9.8 |
| 30 | 1.2 | 4.8 |

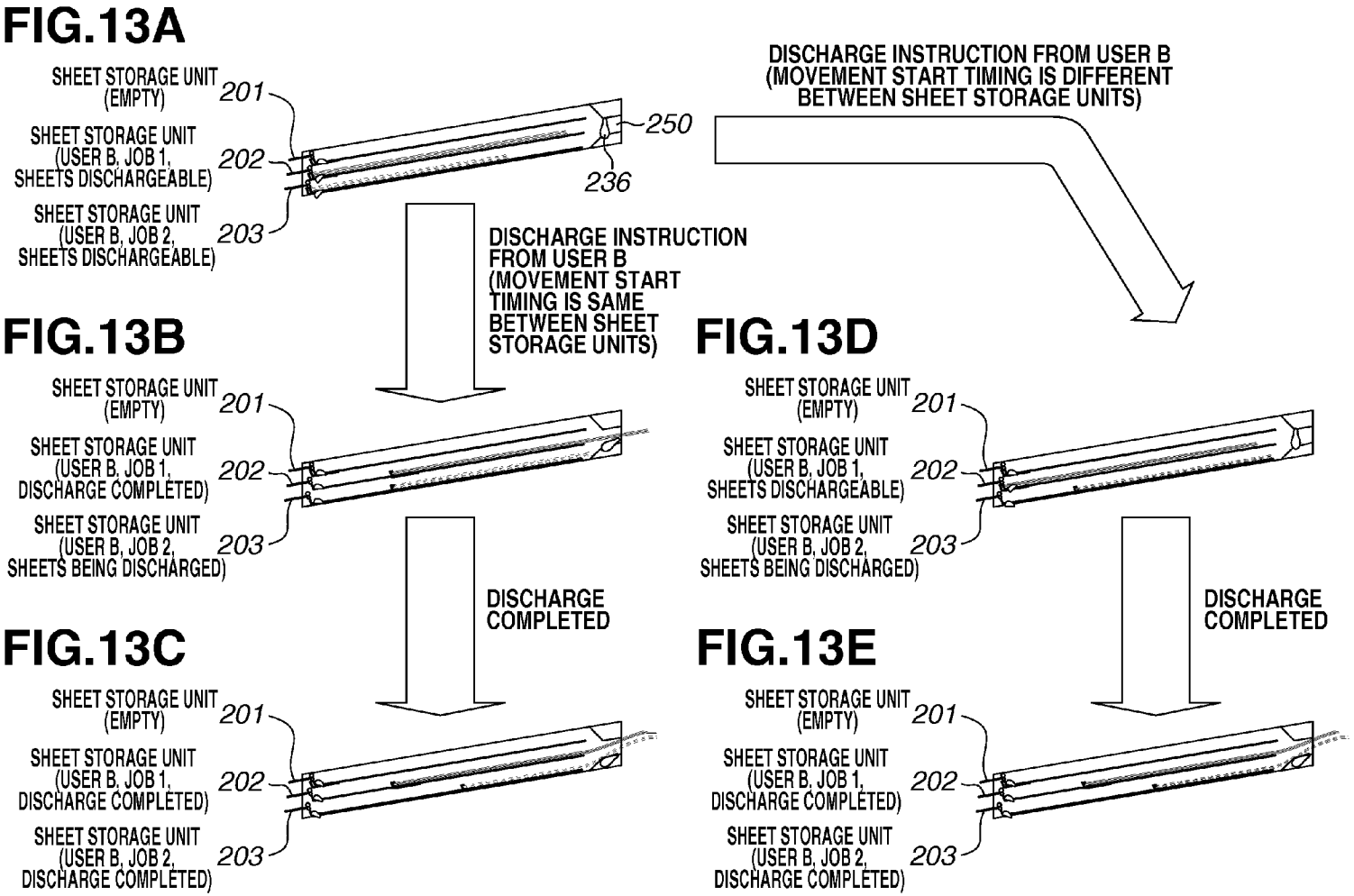
FIG.13A
SHEET STORAGE UNIT (EMPTY)
201
SHEET STORAGE UNIT (USER B, JOB 1, SHEETS DISCHARGEABLE)
202
SHEET STORAGE UNIT (USER B, JOB 2, SHEETS DISCHARGEABLE)
203
250
236
DISCHARGE INSTRUCTION FROM USER B (MOVEMENT START TIMING IS DIFFERENT BETWEEN SHEET STORAGE UNITS)
DISCHARGE INSTRUCTION FROM USER B (MOVEMENT START TIMING IS SAME BETWEEN SHEET STORAGE UNITS)
FIG.13B
SHEET STORAGE UNIT (EMPTY)
201
SHEET STORAGE UNIT (USER B, JOB 1, DISCHARGE COMPLETED)
202
SHEET STORAGE UNIT (USER B, JOB 2, SHEETS BEING DISCHARGED)
203
DISCHARGE COMPLETED
FIG.13C
SHEET STORAGE UNIT (EMPTY)
201
SHEET STORAGE UNIT (USER B, JOB 1, DISCHARGE COMPLETED)
202
SHEET STORAGE UNIT (USER B, JOB 2, DISCHARGE COMPLETED)
203
FIG.13D
SHEET STORAGE UNIT (EMPTY)
201
SHEET STORAGE UNIT (USER B, JOB 1, SHEETS DISCHARGEABLE)
202
SHEET STORAGE UNIT (USER B, JOB 2, SHEETS BEING DISCHARGED)
203
DISCHARGE COMPLETED
FIG.13E
SHEET STORAGE UNIT (EMPTY)
201
SHEET STORAGE UNIT (USER B, JOB 1, DISCHARGE COMPLETED)
202
SHEET STORAGE UNIT (USER B, JOB 2, DISCHARGE COMPLETED)
203

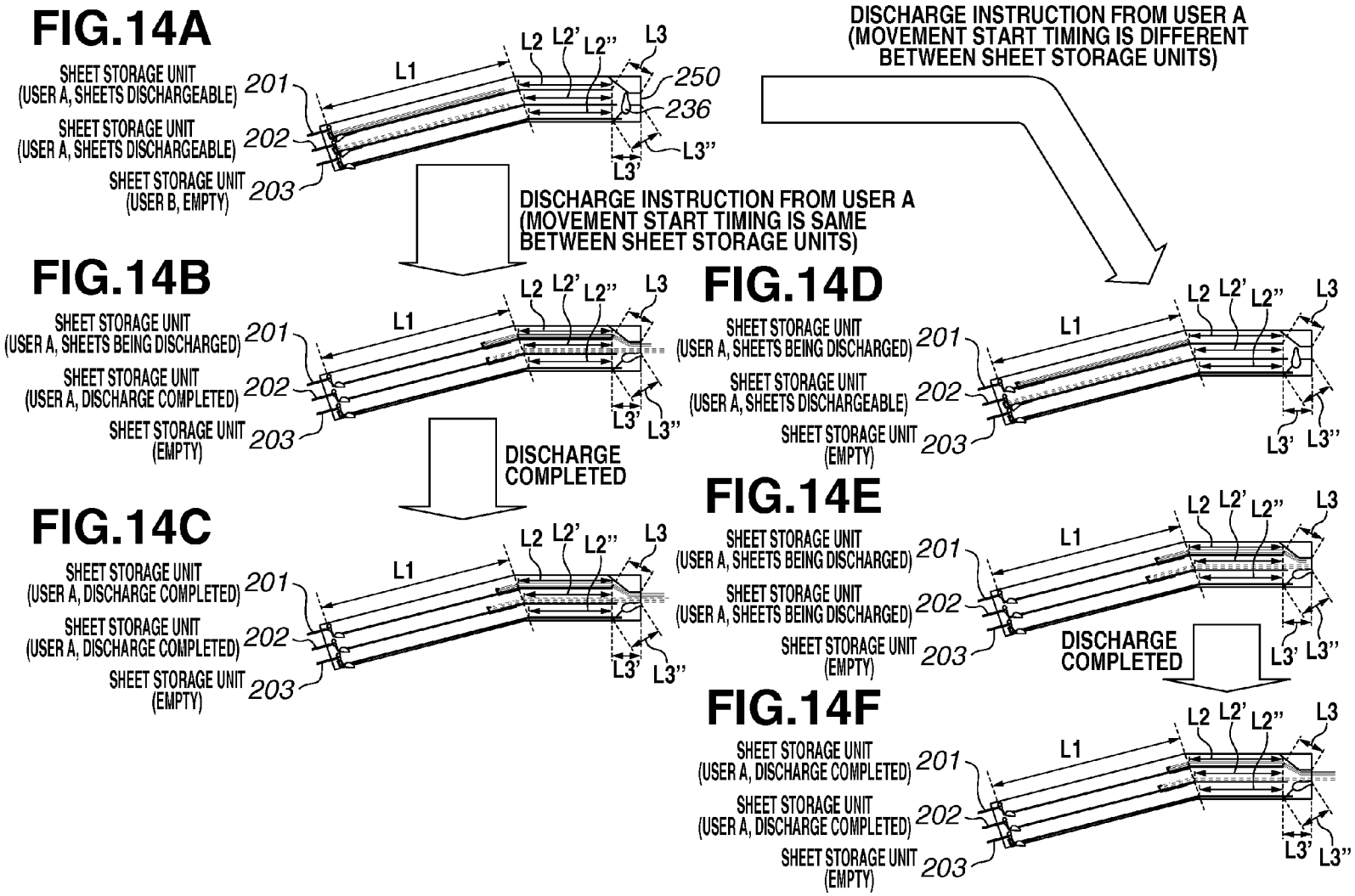
FIG.14A
SHEET STORAGE UNIT (USER A, SHEETS DISCHARGEABLE)
SHEET STORAGE UNIT (USER A, SHEETS DISCHARGEABLE)
SHEET STORAGE UNIT (USER B, EMPTY)
201
202
203
L1
L2
L2'
L2''
L3
L3'
L3''
250
236
DISCHARGE INSTRUCTION FROM USER A (MOVEMENT START TIMING IS SAME BETWEEN SHEET STORAGE UNITS)
FIG.14B
SHEET STORAGE UNIT (USER A, SHEETS BEING DISCHARGED)
SHEET STORAGE UNIT (USER A, DISCHARGE COMPLETED)
SHEET STORAGE UNIT (EMPTY)
DISCHARGE COMPLETED
FIG.14C
SHEET STORAGE UNIT (USER A, DISCHARGE COMPLETED)
SHEET STORAGE UNIT (USER A, DISCHARGE COMPLETED)
SHEET STORAGE UNIT (EMPTY)
DISCHARGE INSTRUCTION FROM USER A (MOVEMENT START TIMING IS DIFFERENT BETWEEN SHEET STORAGE UNITS)
FIG.14D
SHEET STORAGE UNIT (USER A, SHEETS BEING DISCHARGED)
SHEET STORAGE UNIT (USER A, SHEETS DISCHARGEABLE)
SHEET STORAGE UNIT (EMPTY)
FIG.14E
SHEET STORAGE UNIT (USER A, SHEETS BEING DISCHARGED)
SHEET STORAGE UNIT (USER A, SHEETS BEING DISCHARGED)
SHEET STORAGE UNIT (EMPTY)
DISCHARGE COMPLETED
FIG.14F
SHEET STORAGE UNIT (USER A, DISCHARGE COMPLETED)
SHEET STORAGE UNIT (USER A, DISCHARGE COMPLETED)
SHEET STORAGE UNIT (EMPTY)

DISCHARGE INSTRUCTION FROM USER A

PAUSE

DISCHARGE COMPLETED

IMAGE FORMING APPARATUS THAT EJECTS PRINTED SHEETS FROM MULTIPLE TRAYS AT THE SAME TIME

BACKGROUND OF THE INVENTION

1. Field of the Invention

The present invention relates to an image forming apparatus having a sheet storage unit for storing sheets with an image formed thereon, and to a sheet storage device.

2. Description of the Related Art

Some conventional image forming apparatuses such as copying machines and printers have a sheet storage unit for temporarily storing sheets with an image formed thereon inside the apparatus body.

Japanese Patent Application Laid-Open No. 2013-220905 discusses an image forming apparatus having a plurality of sheet storage units for temporarily storing sheets with an image formed thereon inside the apparatus body, in addition to a regular discharge tray that is disposed on the upper face of the apparatus body and is shared by a plurality of users. This image forming apparatus stores sheets in a different sheet storage unit for each job. When a user takes out the sheets stored in a sheet storage unit, the image forming apparatus performs user authentication, for example, through the use of an identification (ID) card. The image forming apparatus performs user authentication when the user causes an ID card reading unit provided on the apparatus body to read his or her ID card. When the user authentication has been successfully performed, the image forming apparatus discharges sheets, for which the user has issued a discharge instruction, from an opening portion to the outside of the apparatus body. In this case, when there is a plurality of target sheet storage units from which the sheets are to be discharged, the sheets stored in the respective sheet storage units are moved at the same time and then exposed from a common opening portion in a stacked manner. This enables the user to take out only his or her sheets with an image formed thereon, and collectively take out the sheets obtained from a plurality of jobs.

There may be a case where, when the sheets stored in the plurality of sheet storage units are to be exposed from the common opening portion, the sheets stored in the respective sheet storage units are different in length. In a configuration discussed in Japanese Patent Application Laid-Open No. 2013-220905, when the sheets in the respective sheet storage units are to be exposed from the opening portion by a predetermined length, the sheets stored in the respective sheet storage units are moved at the same time. In this case, since the sheets stored in the respective sheet storage units are different in length, it takes a different time in each of the sheet storage units to expose the sheets from the opening portion by the predetermined length. Therefore, there arises a situation where, when a first sheet stored in a certain sheet storage unit is exposed from the opening portion by the predetermined length and then stopped, a second sheet stored in another sheet storage unit is being moved. In this case, since the first and the second sheets are exposed from the common opening portion, these sheets may meet and contact each other halfway and then the moving second sheet may thrust out the stopped first sheet. Accordingly, the first sheet is exposed from the opening portion by a length longer than the predetermined length, causing a problem that it becomes hard for the user to collectively take out a plurality of sheets exposed from the opening portion. There has also been a problem that the first sheet falls from the opening portion with a large degree of thrust.

SUMMARY OF THE INVENTION

The present invention is directed to an image forming apparatus and a sheet storage device for reducing the influence of a thrust of sheets while sheets stored in a plurality of sheet storage units are being exposed from a common opening portion.

According to an aspect of the present invention, an image forming apparatus includes an apparatus body in which an opening portion is formed, an image forming unit configured to form an image on a sheet, a plurality of sheet storage units, wherein each sheet storage unit is configured to store, inside the apparatus body, the sheet with the image formed thereon by the image forming unit, and a sheet moving unit provided in each of the plurality of sheet storage units, and configured to move the sheet stored therein and then stop the sheet in an exposed state where the sheet is partly exposed, from the opening portion, to an outside of the apparatus body, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, when a moving distance of the first sheet to bring the first sheet into the exposed state and a moving distance of the second sheet to bring the second sheet into the exposed state are different from each other, the sheet moving unit changes a movement start timing of the first sheet relative to a movement start timing of the second sheet or changes a moving speed of the first sheet relative to a moving speed of the second sheet, based on the moving distance of the first sheet and the moving distance of the second sheet.

Further features of the present invention will become apparent from the following description of exemplary embodiments with reference to the attached drawings.

BRIEF DESCRIPTION OF THE DRAWINGS

FIGS. 10A to 10G illustrate examples of sheet discharge operations according to the first exemplary embodiment of the present invention.

FIGS. 13A to 13E illustrate examples of sheet discharge operations according to a second exemplary embodiment of the present invention.

FIGS. 14A to 14F illustrate examples of sheet discharge operations according to a third exemplary embodiment of the present invention.

DESCRIPTION OF THE EMBODIMENTS

A first exemplary embodiment of the present invention will be described in detail below with reference to the accompanying drawings.

(Configuration of Image Forming Apparatus)

Figure 1:
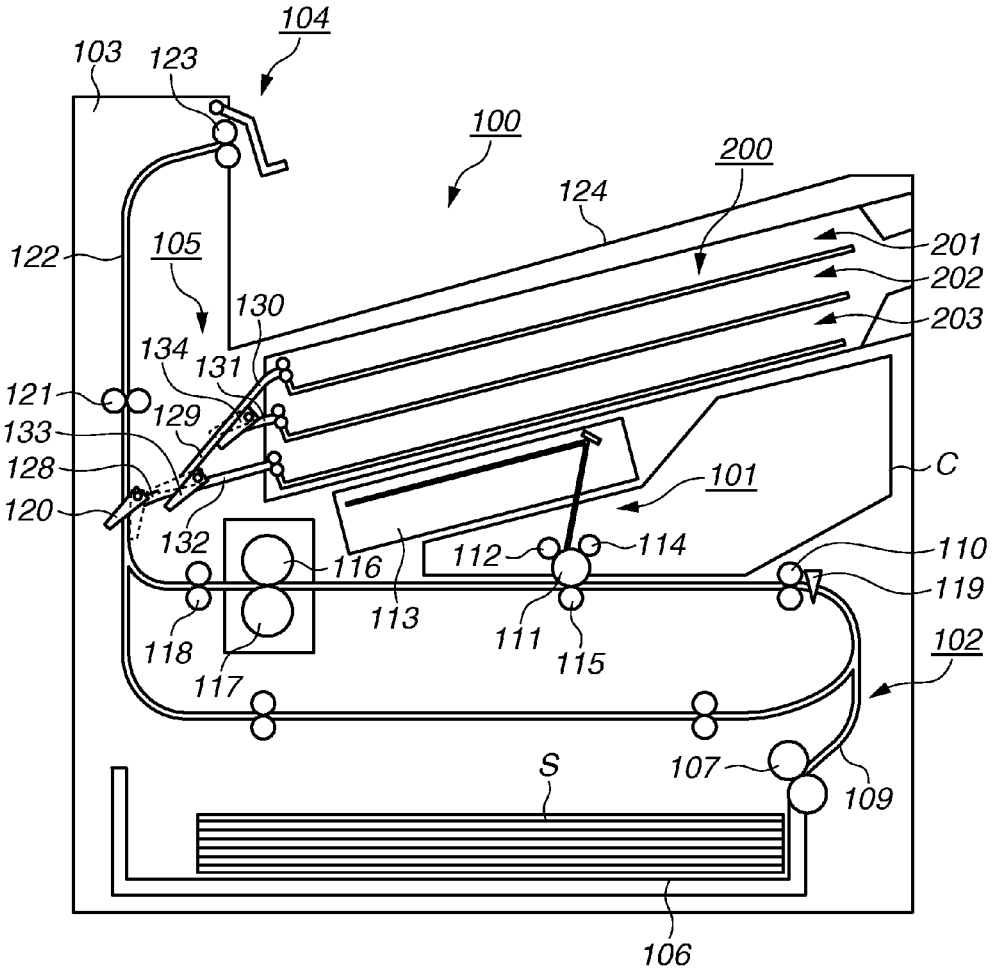
FIG. 1 illustrates a configuration of an image forming apparatus according to a first exemplary embodiments of the present invention.

FIG. 1 illustrates a configuration of an image forming apparatus having sheet storage units according to a first exemplary embodiment of the present invention. In the present exemplary embodiment, a laser beam printer will be described as an example of an image forming apparatus.

An image forming apparatus 100 includes an image forming unit 101, a feed unit 102 for supplying a sheet S to the image forming unit 101, an apparatus body 103, and a discharge unit 104 for discharging the sheet S with an image formed thereon by the image forming unit 101. The sheet S is a medium with an image formed thereon by the image forming apparatus 100, such as paper, an overhead projector (OHP) sheet, and a cloth. The image forming apparatus 100 includes a sheet storage device 200 above the image forming unit 101. The sheet storage device 200 includes a plurality of sheet storage units 201 to 203 for temporarily storing the sheet S with an image formed thereon inside the image forming apparatus 100. The image forming apparatus 100 further includes a conveyance unit 105 for conveying the sheet S with an image formed thereon to the sheet storage device 200.

The image forming unit 101 includes a photosensitive drum 111 which rotates clockwise (in a CW direction) in FIG. 1, a charging roller 112 for charging the surface of the photosensitive drum 111, and an exposure device 113 for irradiating the photosensitive drum 111 with light to form an electrostatic latent image thereon. The image forming unit 101 further includes a developing device 114 for applying toner onto the electrostatic latent image to form a toner image on the photosensitive drum 111, and a transfer roller 115 for transferring the toner image onto the conveyed sheet S. The image forming unit 101 further includes a fixing roller 116, a pressurization roller 117 in contact with the fixing roller 116, and a fixing discharge roller pair 118 to fix to the sheet S the toner image transferred to the sheet S. The image forming unit 101 forms a toner image on the sheet S through the above-described electrophotographic image forming process.

In the image forming apparatus 100 according to the present exemplary embodiment, the photosensitive drum 111, the charging roller 112, the developing device 114, and a toner storage unit (not illustrated) for storing toner are integrated into a cartridge C. The cartridge C is detachably attached to the apparatus body 103. When the toner runs out, the user can replace the cartridge C with a new cartridge C. This enables the user to maintain the image forming apparatus 100 without relying on service personnel. The present exemplary embodiment is not limited to the above-described cartridge type image forming apparatus 100, and also applicable to a configuration in which components such as the photosensitive drum 111, the charging roller 112, and developing device 114 are installed in the apparatus body 103 (an image forming apparatus of this type does not require replacement of such components).

The feed unit 102 includes a supply cassette 106 in which a plurality of sheets S to be used for image formation is stored in a stacked manner, a supply roller pair 107, a conveyance guide 109, and a registration roller pair 110. Further, a registration sensor 119 disposed in the vicinity of the registration roller pair 110. When the registration sensor 119 detects the leading edge of the conveyed sheet S, the image forming unit 101 determines the timing for starting the image formation. The registration sensor 119 includes a flag and a photo-interrupter (not illustrated). When the flag is activated by the conveyed sheet S, an ON/OFF signal is output from the photo-interrupter.

The discharge unit 104 includes a first switching member 120, a conveyance roller pair 121, a discharge guide 122, a discharge roller pair 123, and a discharge tray (stacking unit) 124. Referring to FIG. 1, the first switching member 120 is configured to be switched by an actuator (not illustrated) between a position, which is indicated with a solid line, for directing the sheet S with an image formed thereon to the sheet storage device 200 and a position, which is indicated with a dashed line, for directing the sheet S to the discharge tray 124. The discharge tray 124 is disposed on the upper face of the image forming apparatus 100 so as to be shared by a plurality of users. The sheet S is discharged onto the discharge tray 124 with the image formation surface (front surface) downward (faced down).

The conveyance unit 105 includes a second switching member 133 and a third switching member 134 for switching the conveyance destination of the sheet S, and conveyance guides 128 to 132 for guiding the sheet S to the sheet storage units 201 to 203. Referring to FIG. 1, each of the second switching member 133 and the third switching member 134 is configured to be switched by an actuator (not illustrated) between a position indicated with a solid line and a position indicated with a dashed line. For example, when conveying the sheet S to the first sheet storage unit 201, each of the second switching member 133 and the third switching member 134 is switched to the position indicated with the solid line illustrated in FIG. 1. The sheet S is conveyed from the conveyance guide 128, passes through the conveyance guides 129 and 130 in this order, and is conveyed to the sheet storage unit 201. When conveying the sheet S to the second sheet storage unit 202, only the third switching member 134 is switched to the position indicated with the dashed line. In this case, the sheet S passes through the conveyance guides 128, 129, and 131 in this order, and is conveyed to the sheet storage unit 202. Similarly to the discharge tray 124, the sheet S is stored in each of the sheet storage units 201 to 203 in a face-down state.

(Configuration of Sheet Storage Device)

Figure 2:
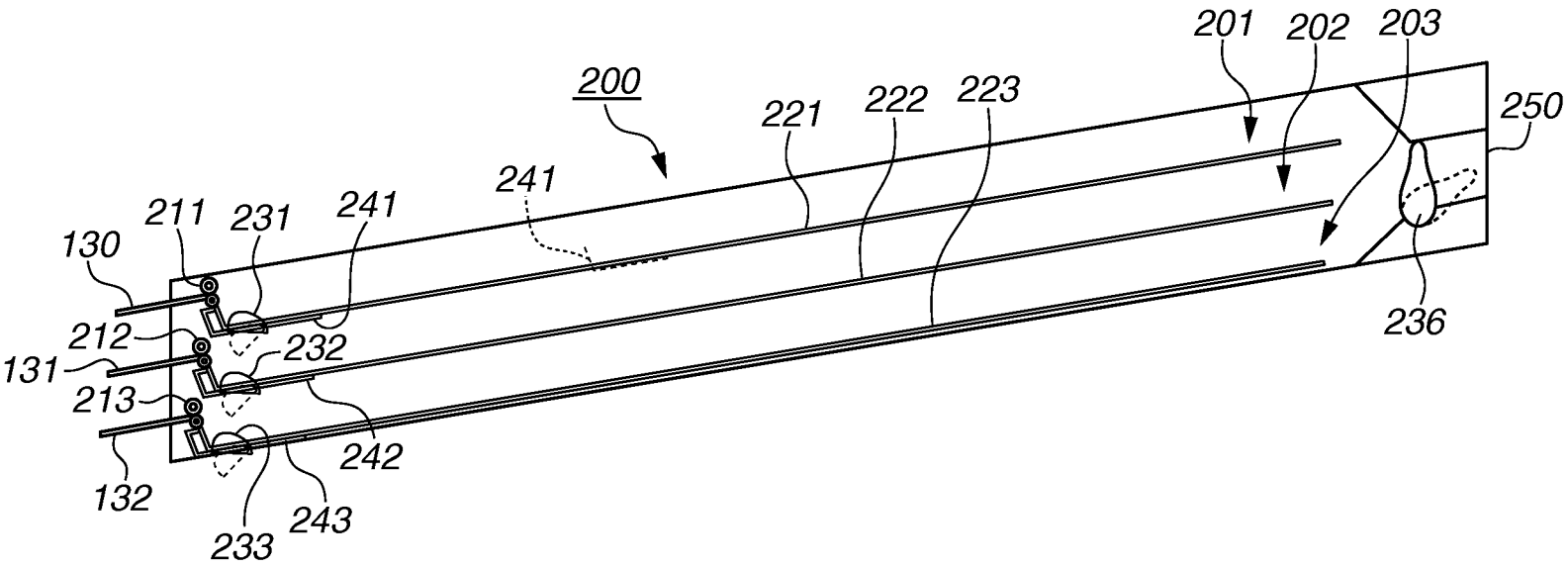
FIG. 2 illustrates a configuration of a sheet storage device according to the first exemplary embodiment of the present invention.

FIG. 2 illustrates a configuration of the sheet storage device 200. In the sheet storage device 200 according to the present exemplary embodiment, a plurality of stages of the sheet storage units 201 to 203 is vertically disposed in a stacked manner. Since each of the sheet storage units 201 to 203 has a similar configuration, the configuration of the first sheet storage unit 201 will be described below.

The sheet storage unit 201 includes a conveyance roller 211 for conveying the sheet S, a stack tray 221 for stacking and temporarily storing the sheet S inside the apparatus body 103, and a sheet presence sensor 231 for detecting whether the sheet S is stored in the stack tray 221. The sheet storage unit 201 further includes a sheet moving unit 241 for pressing the trailing edge of the stored sheet S (the edge of the sheet S on the upstream side in the sheet conveyance direction) and exposing a part of the stored sheet S to the outside of the apparatus body 103. The sheet moving unit 241 moves the sheet S to the position where the user can receive the sheet S, i.e., until the leading edge of the sheet S (the edge of the sheet S on the downstream side in the sheet conveyance direction) passes an opening portion 250. Thus, the sheet S can be exposed to the outside of the apparatus body 103 by a predetermined length. In the present exemplary embodiment, the predetermined length of the sheet S to be exposed to the outside of the apparatus 100 is set to 30 mm. This predetermined length is an example, and may be set to a value that allows the user to hold the exposed sheets S and prevents the sheets S from being largely bent.

The length of the tray 221 is set to a value that prevents the leading edge of the sheet S from not being exposed from the opening portion 250 even when the sheet S having the maximum storable size is stacked in the sheet storage unit 201. When the sheets S are stacked in the stack tray 221 and accordingly the stacked sheets S slant the sheet presence sensor 231 to the position indicated with a dashed line, the sheet presence sensor 231 turns ON. When the sheets S are moved by the sheet moving unit 241 and accordingly the sheet presence sensor 231 returns to the position indicated with a solid line, the sheet presence sensor 231 turns OFF. Further, when the leading edges of the moved sheets S slant the opening sensor 236 disposed in the vicinity of the opening portion 250 to the position indicated with a dashed line, the opening sensor 236 turns ON. When the sheets S exposed to the outside of the apparatus body 103 are removed and accordingly the opening sensor 236 returns to the position indicated with a solid line, the opening sensor 236 turns OFF. While the sheets S are successively being conveyed to the sheet storage unit 201, the sheet moving unit 241 is placed in a stacked position indicated with a solid line. On the other hand, the sheet moving unit 241 is configured to be movable toward the opening portion 250 along the conveyance direction of the sheets S, and to an exposed position indicated with a dashed line when exposing the stored sheets S. The exposed position, i.e., the moving distance of the sheet moving unit 241 is determined according to the length of the sheets S to be exposed and the size of the sheets S in the sheet conveyance direction.

Figure 3:
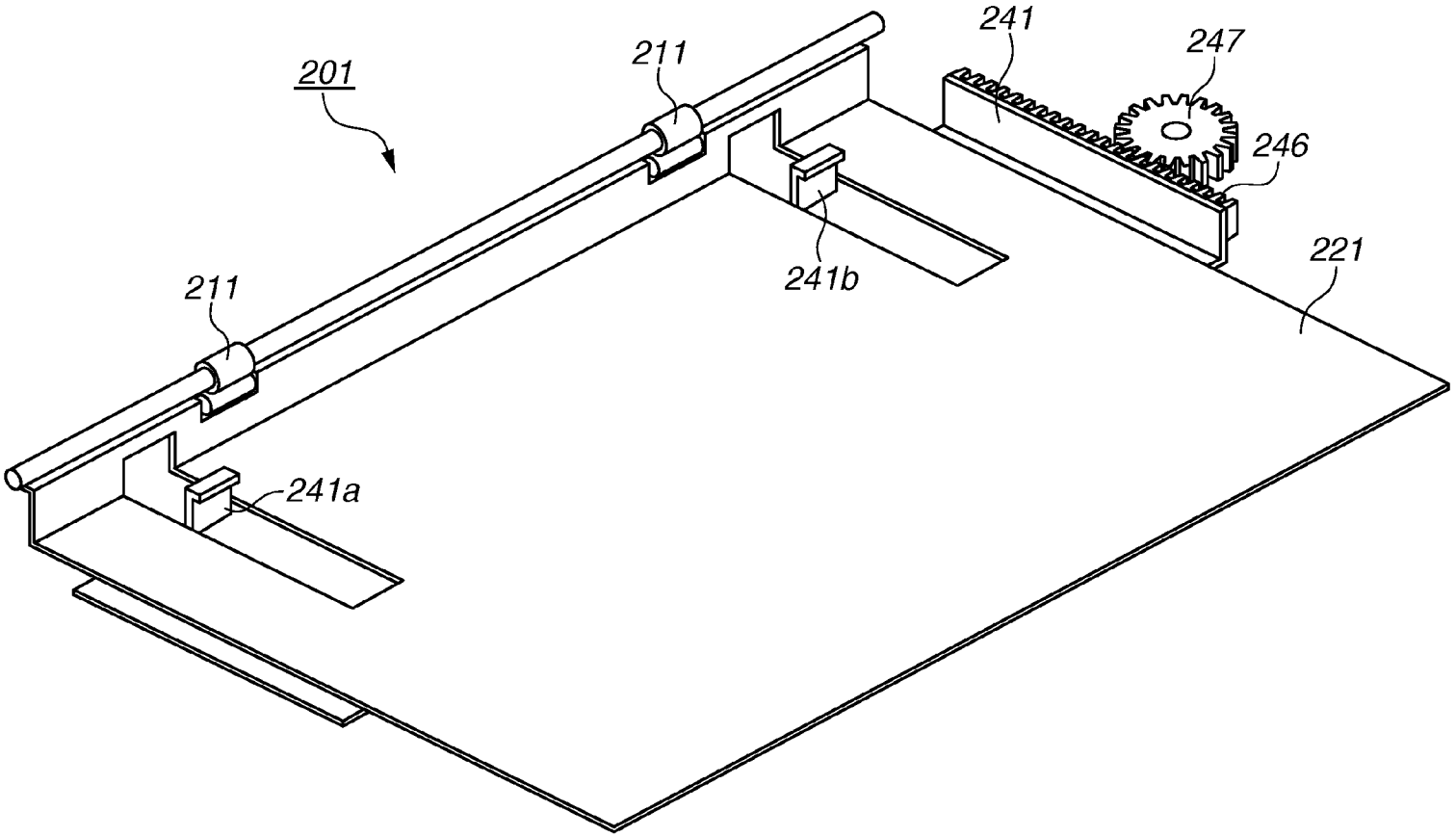
FIG. 3 is a perspective view illustrating a sheet storage unit according to the first exemplary embodiment of the present invention.

FIG. 3 is a perspective view illustrating the sheet storage unit 201. Referring to FIG. 3, the sheet moving unit 241 is placed between the stacked position and the exposed position. The sheet moving unit 241 is provided with two sheet trailing edge pressing units 241*a* and 241*b* in the width direction of the sheets S. The sheet moving unit 241 is integrally provided with a rack gear 246. The rack gear 246 is engaged with a pinion gear 247 which is connected to an actuator as a drive unit (not illustrated in FIG. 3). Driving the actuator in the forward and reverse directions enables the sheet moving unit 241 to reciprocally move between the stacked position and the exposed position.

(Block Diagram of Control Unit and Functional Configuration)

Figure 4:
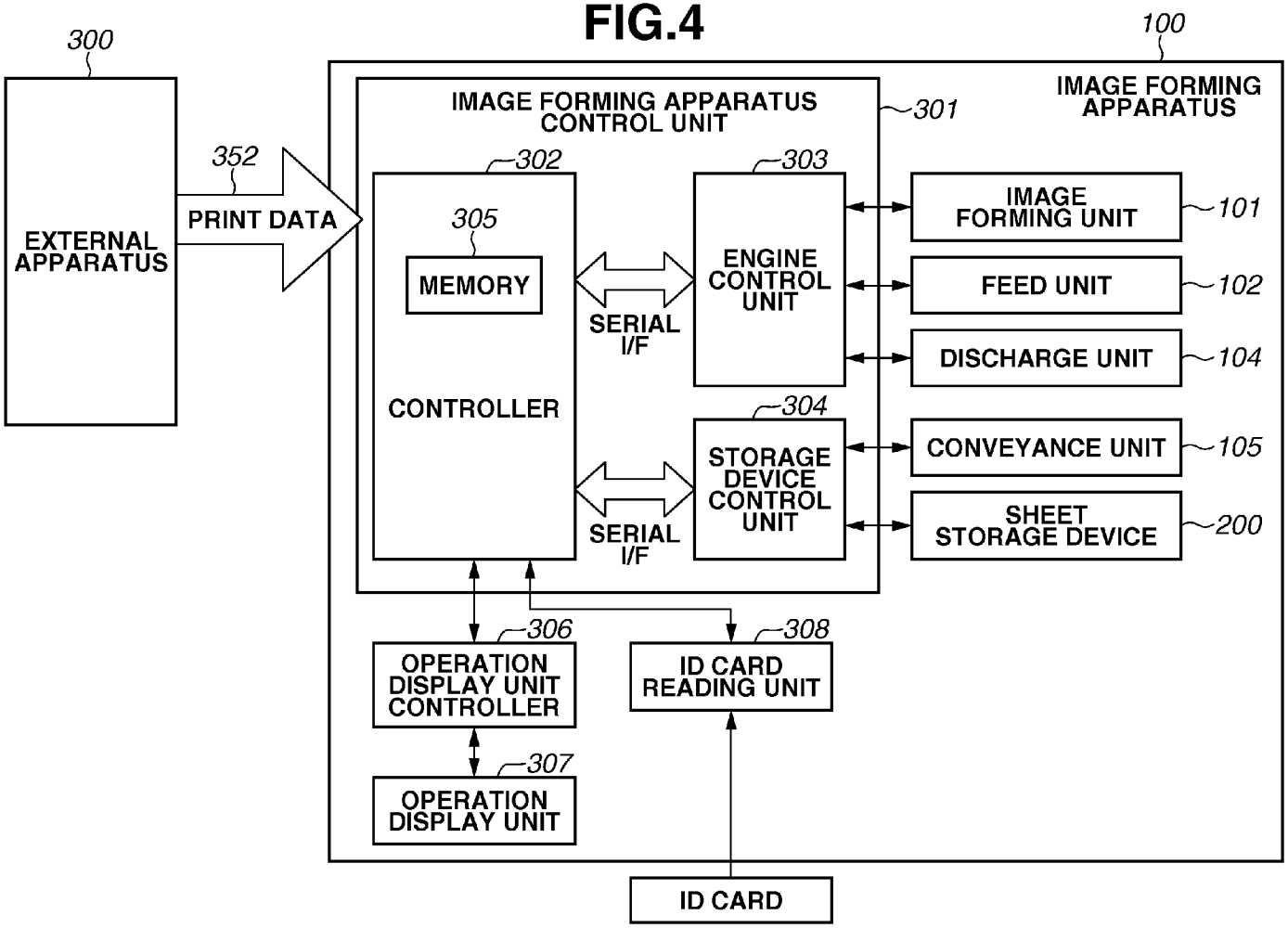
FIG. 4 is a block diagram illustrating control units and a functional configuration of the image forming apparatus according to the first exemplary embodiment of the present invention.

FIG. 4 is a block diagram illustrating control units and a functional configuration according to the present exemplary embodiment. The image forming apparatus 100 includes an image forming apparatus control unit 301 as a control unit. The image forming apparatus control unit 301 includes a controller 302, an engine control unit 303, and a storage device control unit 304.

The controller 302 communicates with an external apparatus 300 such as a host computer to receive print data 352, and stores the received print data 352 in a memory 305 (for example, a random access memory (RAM)). The controller 302 analyzes the print data 352 stored in the memory 305 to generate print conditions. The print conditions refer to information indicating the number of sheets S to be supplied, the discharge destination of the sheets S with an image formed thereon (the discharge tray 124 or the sheet storage device 200), and the print image density. Then, the controller 302 provides the print conditions generated based on the print data 352 to the engine control unit 303 via a serial interface (I/F). The engine control unit 303 controls each mechanism according to the print conditions received from the controller 302. More specifically, the engine control unit 303 controls the image forming unit 101 to form an image on the sheets S, and controls the feed unit 102 and the discharge unit 104 to supply and discharge the sheets S, respectively.

The controller 302 analyzes the print data 352 stored in the memory 305 to generate storage conditions and discharge conditions for the sheet storage units 201 to 203. Then, the controller 302 provides the storage conditions and the discharge conditions generated based on the print data 352 to the storage device control unit 304 via the serial I/F. The storage conditions refer to information such as the storage destination of the sheets S with an image formed thereon and the number of the sheets S to be stored. The discharge conditions refer to information such as the distances over which the sheet moving units 241 to 243 are to be moved to expose the sheets S from the opening portion 250. The storage device control unit 304 controls each mechanism according to the storage conditions and the discharge conditions received from the controller 302. More specifically, the storage device control unit 304 controls the conveyance unit 105 to convey the sheets S with an image formed thereon to the sheet storage units 201 to 203, and controls the sheet storage device 200 having the sheet moving unit 241 to move the sheets S stored in the sheet storage units 201 to 203 to the opening portion 250. An operation display unit controller 306 performs control to notify the controller 302 of various settings or a discharge instruction performed by the used on an operation display unit 307. Alternatively, the operation display unit controller 306 instructs the controller 302 to discharge the sheets S based on user information acquired from an ID card via an ID card reading unit 308.

(Details of Storage Device Control Unit)

Figure 5:
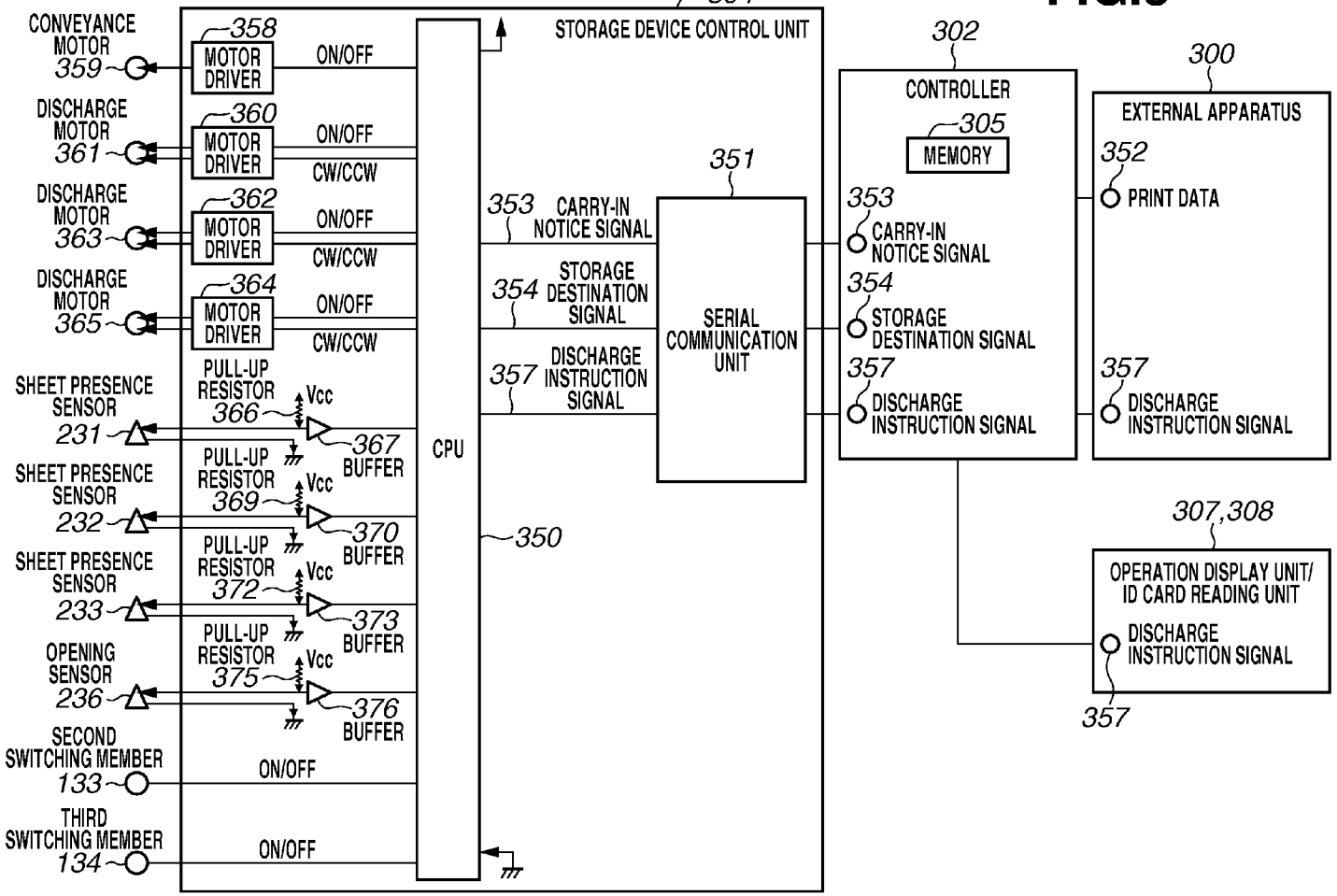
FIG. 5 is a detailed diagram illustrating a storage device control unit according to the first exemplary embodiment of the present invention.

FIG. 5 is a detailed diagram illustrating the storage device control unit 304 according to the present exemplary embodiment. The storage device control unit 304 includes a central processing unit (CPU) 350 and communicates with the controller 302 via a serial communication unit 351. The serial communication unit 351 connects the controller 302 and the CPU 350 with a plurality of signal lines. In the present exemplary embodiment, the serial communication unit 351 has three signal lines for transmitting a carry-in notice signal 353, a storage destination signal 354, and a discharge instruction signal 357 (described below).

Control for storing the sheets S in the sheet storage device 200 will be described below. When the controller 302 is notified of the print data 352 via the external apparatus 300, the controller 302 temporarily stores the print data 352 in the memory 305. Then, the controller 302 analyzes the stored print data 352, and notifies the CPU 350 of the carry-in notice signal 353 and the storage destination signal 354 via the serial communication unit 351. Based on these signals, the CPU 350 controls each actuator (described below) to convey the sheets S, which have been subjected to printing, to the sheet storage units 201 to 203.

Control for exposing the sheets S from the sheet storage device 200 will be described below. When the user issues an instruction for discharging the sheets S stored in a sheet storage unit, via the external apparatus 300, the operation display unit 307, or the ID card reading unit 308, the controller 302 is notified of the discharge instruction signal 357. The controller 302 determines a sheet storage unit from which the sheets S are to be discharged, and then notifies the CPU 350 of the discharge instruction signal 357 via the serial communication unit 351 to instruct the CPU 350 to discharge the sheets S stored in the determined sheet storage unit. The CPU 350 controls each actuator (described below) to expose the sheets S in the determined sheet storage unit from the opening portion 250 to the outside of the apparatus body 103.

Each actuator connected to the CPU 350 will be described below.

A motor driver 358 is connected to an output terminal of the CPU 350. The motor driver 358 drives a conveyance motor 359. When the conveyance motor 359 rotates, the conveyance rollers 211, 212, and 213 rotate to convey the sheets S to the sheet storage units 201, 202, and 203, respectively.

A motor driver 360 is connected to an output terminal of the CPU 350. The motor driver 360 drives a discharge motor 361. When the discharge motor 361 rotates clockwise (in a CW direction), the sheet moving unit 241 of the sheet storage unit 201 moves toward the opening portion 250. When the discharge motor 361 rotates counterclockwise (in a CCW direction), the sheet moving unit 241 of the sheet storage unit 201 moves in the direction opposite to the opening portion 250. Likewise, motor drivers 362 and 364 are connected to output terminals of the CPU 350 and drive discharge motors 363 and 365, respectively. The discharge motor 363 controls the sheet moving unit 242 of the sheet storage unit 202. The discharge motor 365 controls the sheet moving unit 243 of the sheet storage unit 203.

The sheet presence sensor 231 uses a pull-up resistor 366 to input to the CPU 350 via a buffer 367 information about whether the sheet storage unit 201 stores the sheets S. Likewise, a sheet presence sensor 232 inputs to the CPU 350 information about whether the sheet storage unit 202 stores the sheets S, and a sheet presence sensor 233 inputs to the CPU 350 information about whether the sheet storage unit 203 stores the sheets S.

The opening sensor 236 uses a pull-up resistor 375 to input to the CPU 350 via a buffer 376 information about whether the sheets S are exposed from the opening portion 250 to the outside of the image forming apparatus 100.

An actuator (not illustrated) for switching the second switching member 133 is connected to an output terminal of the CPU 350. When the actuator is ON, the second switching member 133 is switched so that the sheets S are conveyed toward the conveyance guide 129. When the actuator is OFF, the second switching member 133 is switched so that the sheets S are conveyed toward the conveyance guide 132. Likewise, an actuator (not illustrated) for switching the third switching member 134 is connected to an output terminal of the CPU 350. When the actuator is ON, the third switching member 134 is switched so that the sheets S are conveyed toward the conveyance guide 130. When the actuator is OFF, the third switching member 134 is switched so that the sheets S are conveyed toward the conveyance guide 131. The CPU 350 switches the second switching member 133 and the third switching member 134 based on the storage destination signal 354 provided by the controller 302.

(Descriptions of Operations of Sheet Storage Device)

Figure 6:
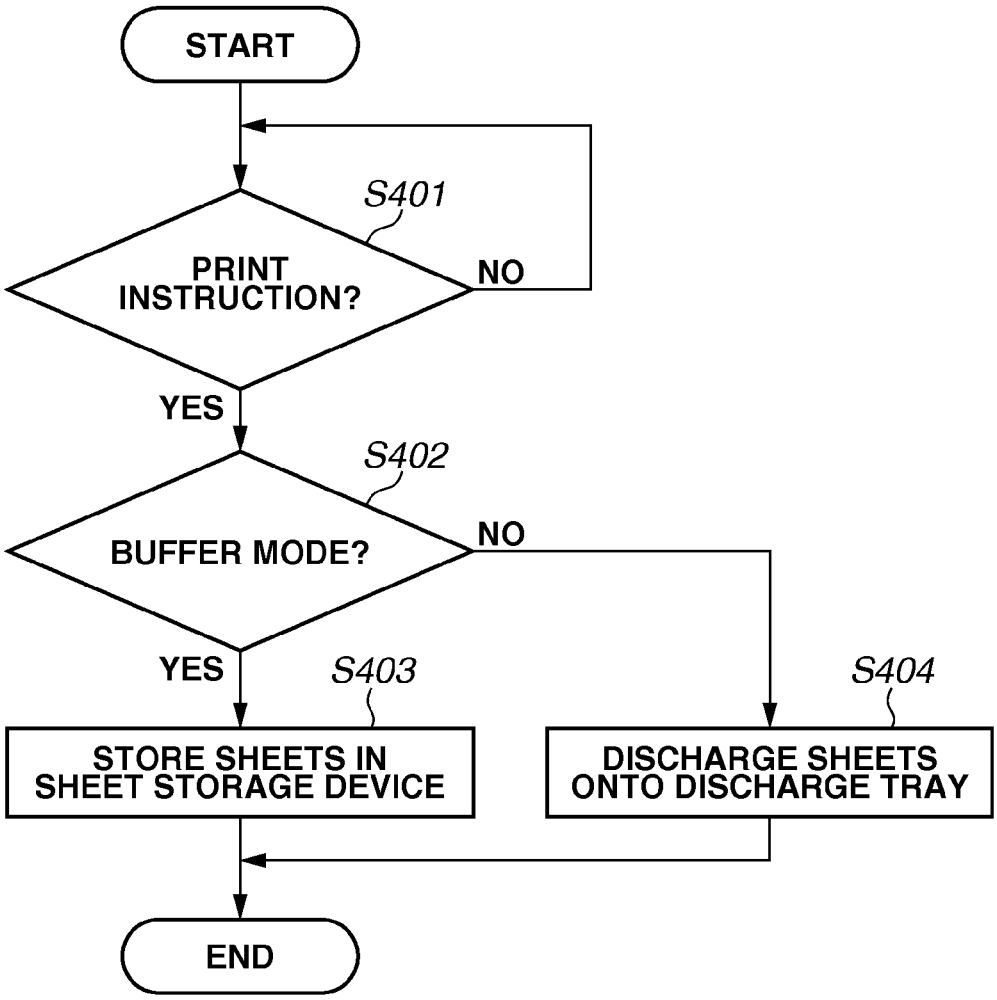
FIG. 6 is a flowchart illustrating sheet printing processing according to the first exemplary embodiment of the present invention.

In the above-described image forming apparatus 100, the user can select either a buffer mode or a normal mode via the external apparatus 300 or the operation display unit 307. In the buffer mode, the sheets S are temporarily stored in the sheet storage device 200. In the normal mode, the sheets S are discharged onto the discharge tray 124. The selected mode is stored in the memory 305. FIG. 6 is a flowchart illustrating processing performed when the user issues an instruction for printing the sheets S. Control according to the flowchart is implemented by the controller 302 illustrated in FIG. 4 based on a program stored in the memory 305.

In step S401, when the user issues an instruction for printing the sheets S via the external apparatus 300, the print data 352 is transmitted to the controller 302. When the controller 302 receives the print data 352 (YES in step S401), then in step S402, the controller 302 determines whether the buffer mode is selected by referencing the information stored in the memory 305. When the buffer mode is selected (YES in step S402), then in step S403, the controller 302 temporarily stores the sheets S in the sheet storage device 200. When the normal mode is selected (NO in step S402), then in step S404, the controller 302 discharges the sheets S onto the discharge tray 124. This completes the control according to this flowchart. Although, in the flowchart illustrated in FIG. 6, it is assumed that the user preselects the mode, the configuration is not limited thereto. For example, the user may determine in which mode the sheets S are to be discharged each time the user issues a print instruction.

In the present exemplary embodiment, when storing the sheets S in the sheet storage device 200, the controller 302 sorts the sheets S for different job numbers into different sheet storage units. When exposing the sheets S from the sheet storage device 200, the sheets S for which the user has issued a discharge instruction are exposed from the opening portion 250 to the outside of the apparatus body 103. The user can issue a discharge instruction by entering a preset password via the external apparatus 300 or the operation display unit 307. Alternatively, the user can issue a discharge instruction when the user causes the ID card reading unit 308 to read his or her ID card to perform user authentication. In the present exemplary embodiment, as described above, the sheet storage units 201 to 203 are provided with separate actuators for driving the sheet moving units 241 to 243, respectively. Therefore, even when the sheets S of the same user are stored in a plurality of sheet storage units, driving the respective actuators allows the user to collectively receive the sheets S. Further, the job number for the sheets S and information about the user who has issued an instruction for printing the sheets S are stored in the memory 305 provided in the controller 302. When the user issues an instruction for discharging the sheets S, the controller 302 identifies the sheets S as the discharge target by referring to the memory 305, and instructs the sheet storage device 200 to discharge the sheets S.

Figure 7A:
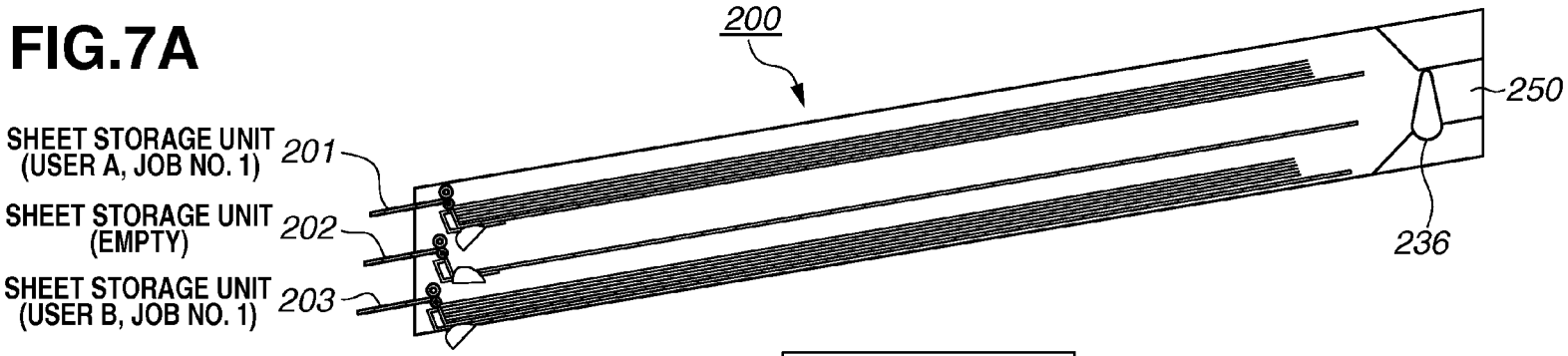
FIGS. 7A and 7B illustrate a state of the sheet storage device before and after sheet exposure according to the first exemplary embodiments of the present invention.
Figure 7B:
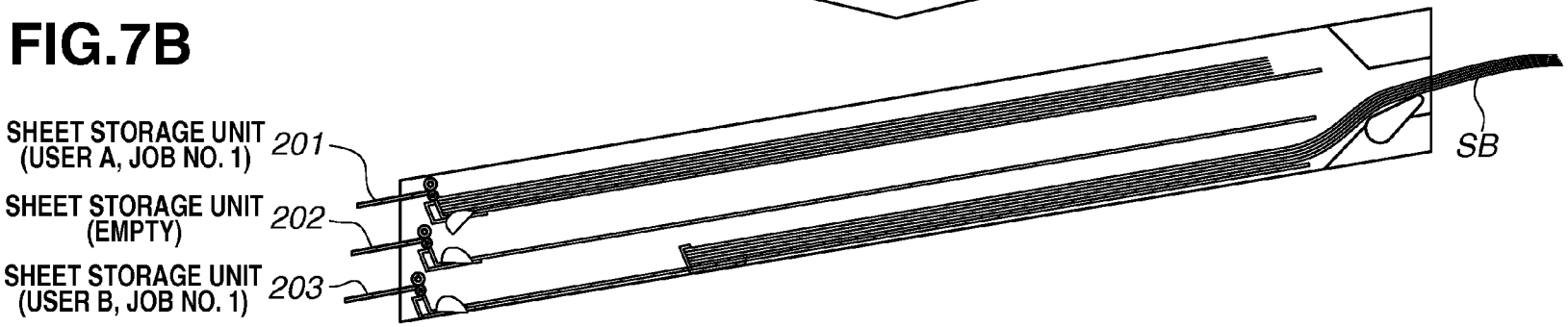

FIGS. 7A and 7B illustrate examples of operations of the sheet storage device 200. Referring to FIG. 7A, the sheet storage unit 201 stores sheets S of a user A, the sheet storage unit 203 stores sheets S of a user B, and the sheet storage unit 202 stores no sheet. Referring to FIG. 7B, when an instruction for discharging the sheets S of the user B is issued, the sheet moving unit 243 of the sheet storage unit 203 moves toward the opening portion 250 to expose a sheet bundle SB from the opening portion 250. Thus, a state where a part of the sheets S is in a sheet storage unit and another part of the sheets S is exposed from the opening portion 250 is defined as an exposed state.

Figure 8:
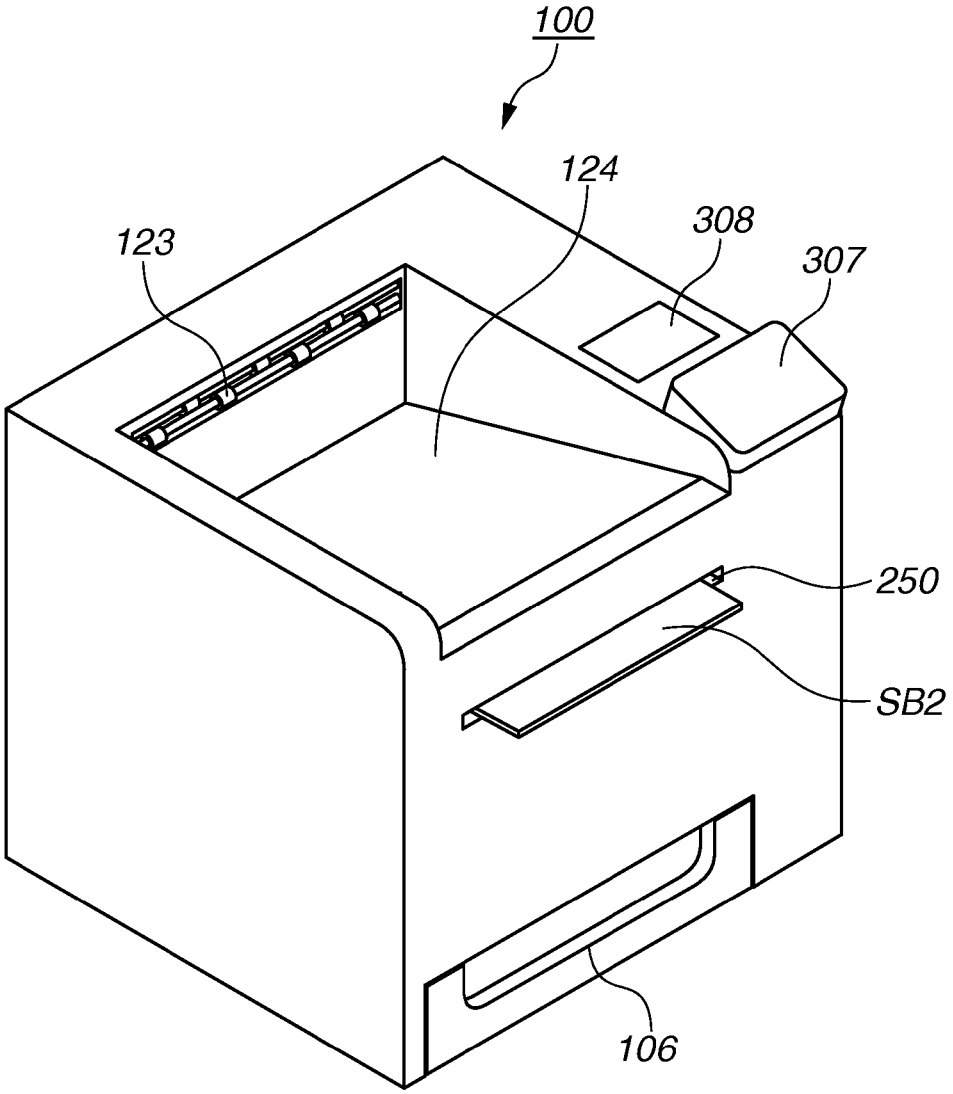
FIG. 8 is a perspective view illustrating the image forming apparatus with exposed sheets according to the first exemplary embodiment of the present invention.

FIG. 8 is a perspective view illustrating the image forming apparatus 100 in the exposed state. A leading edge SB2 of the sheet bundle SB exposed from the sheet storage unit 203 is exposed from the opening portion 250. The user can receive the sheet bundle SB by holding the leading edge SB2 exposed to the outside of the apparatus body 103 and then pulling out the sheet bundle SB.

When the user issues an instruction for storing more sheets S than the number of sheets storable in one sheet storage unit, the controller 302 sorts the sheets S into different sheet storage units even with the same job number. For example, referring to FIG. 7A, the sheet storage unit 203 stores the sheets S of the user B for job number 1. However, when the number of sheets for job number 1 exceeds the maximum number of sheets storable in the sheet storage unit 203, the controller 302 sorts the sheets S for job number 1 into the sheet storage unit 202. However, this processing is performed on the premise that the sheet storage unit 202 stores no other sheets S. Other sheets include sheets having different job numbers and sheets of different users.

The circumference of the sheet storage device 200, except for a conveyance slot (not illustrated) for conveying the sheets S and the opening portion 250 for exposing the stored sheets S, is surrounded by a member. The member surrounding the sheet storage device 200 is made of an opaque material. Therefore, in a state where the sheet storage units 201 to 203 store the sheets S, no user can view information printed on the sheets S in each of the sheet storage units 201 to 203. This configuration prevents information printed on the sheets S of a user from being seen by the other users, improving the confidentiality of information.

On the other hand, for the purpose of improving the confidentiality of information, some image forming apparatuses perform user authentication through the use of an ID card, and then starts image formation. However, in comparison with such apparatuses, the image forming apparatus 100 according to the present exemplary embodiment only needs to perform the operation for exposing the sheets S with an image formed thereon from the sheet storage units 201 to 203. Therefore, after performing user authentication, the user can quickly take out the sheets S without waiting for completion of image formation.

Further, when the user issues an instruction for discharging the sheets S to the image forming apparatus 100, the user can take out only his or her sheets S. This eliminates the user's need to find his or her sheets in the discharge tray 124 in which the user's sheets and the others' sheets are stacked together.

(Descriptions of Operations for Exposing Sheets from a Plurality of Sheet Storage Units)

Figure 9:
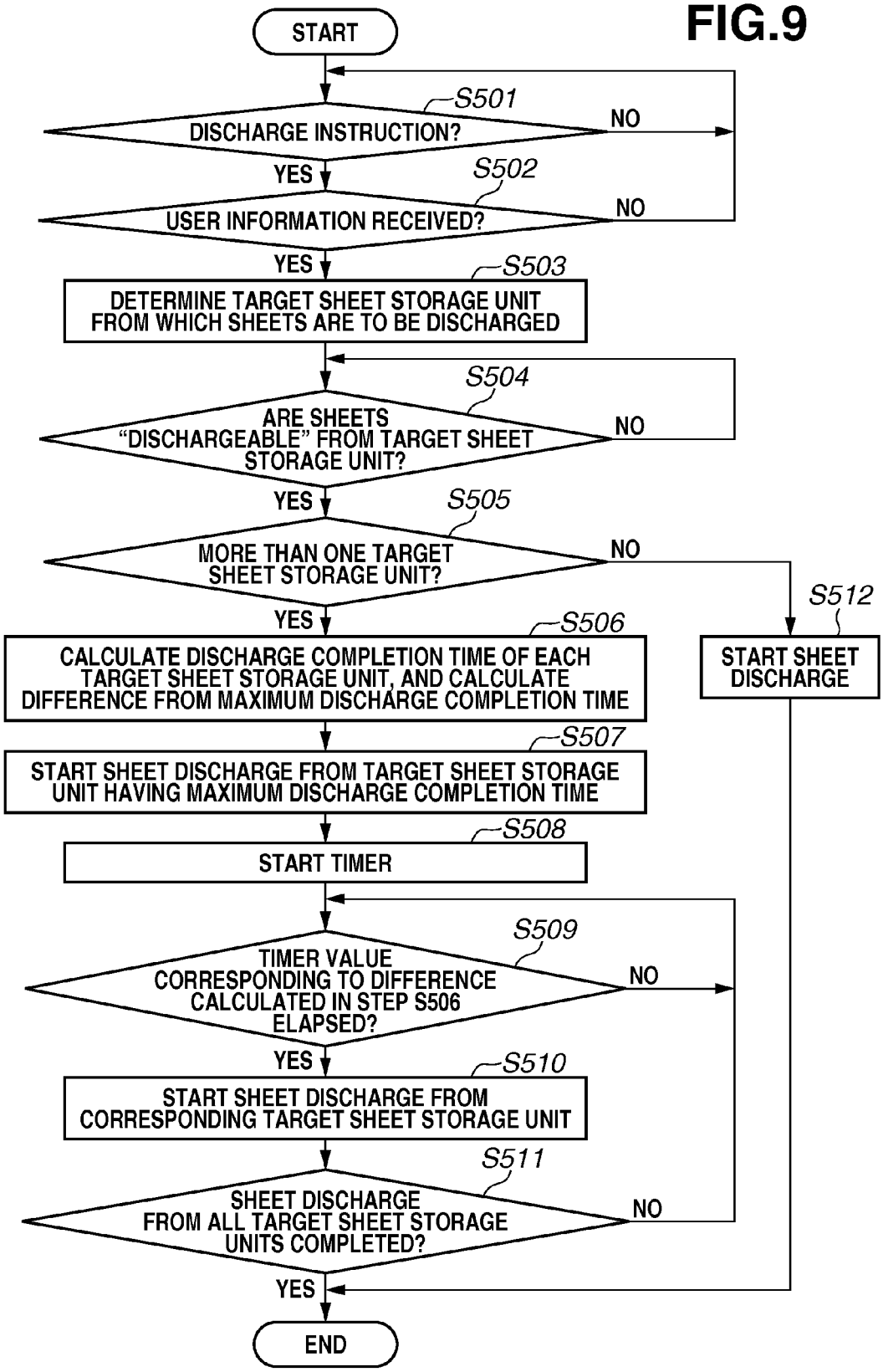
FIG. 9 is a flowchart illustrating sheet discharge processing according to the first exemplary embodiment of the present invention.

An operation for exposing sheets from a plurality of sheet storage units in the above-described image forming apparatus 100 will be described below. FIG. 9 is a flowchart of the operation according to the present exemplary embodiment. Control based on the flowchart is implemented by the controller 302 illustrated in FIG. 4 based on a program stored in the memory 305.

Referring to FIG. 9, in step S501, the controller 302 determines whether a sheet discharge instruction is received from the user. When the controller 302 receives a sheet discharge instruction from the user (YES in step S501), then in step S502, the controller 302 informs the storage device control unit 304 of the discharge instruction and then determines whether user information has been received. When the controller 302 determines that the user information has not yet been received (NO in step S502), the processing returns to step S501. When the controller 302 determines that the user information has already been received (YES in step S502), then in step S503, the controller 302 determines a target sheet storage unit from which the sheets are to be discharged, based on the received user information. In step S504, the controller 302 determines whether the sheets stacked in the target sheet storage unit can be discharged. More specifically, the controller 302 determines whether the sheet conveyance to the target sheet storage unit is completed. The controller 302 counts the number of sheets conveyed to the sheet storage units 201 to 203, and stores the number in the memory 305 (such as a RAM). Therefore, the controller 302 can determine whether the sheet conveyance is completed for a sheet storage unit by comparing the number of sheets to be conveyed to the sheet storage unit with the number of sheets stored in the memory 305. A sheet storage unit to which the sheet conveyance is completed is determined to be in the "sheets dischargeable" state, and an empty sheet storage unit (with no stacked sheets) and a sheet storage unit to which the sheet conveyance is not completed are not determined to be in the "sheets dischargeable" state. The controller 302 can determine whether sheets are stacked in the sheet storage units 201 to 203 based on the results of detections by the sheet presence sensors 231 to 233, respectively.

In step S505, the controller 302 determines whether there is more than one target sheet storage unit. When there is more than one target sheet storage unit (YES in step S505), the processing proceeds to step S506. On the other hand, when there is only one target sheet storage unit (NO in step S505), then in step S512, the controller 302 discharges the sheets serving as the discharge target. In step S506, the controller 302 calculates the discharge completion time (n) of each of the target sheet storage units (n) based on Formula 1. The discharge completion time (n) refers to the time from when a sheet stored in the target sheet storage unit (n) is moved by a sheet moving unit until when the sheet is exposed from the opening portion 250 by a predetermined length (until when the sheet is brought into the exposed state). Referring to Formula 1, "Distance" refers to the distance from the upstream position of each of the sheet storage units 201 to 203 to the opening portion 250, i.e., the distance from each of the sheet moving units 241 to 243 in the stacked position to the opening portion 250. In the present exemplary embodiment, the distance of each of the sheet storage units 201 to 203 is assumed to be approximately equal, and the difference can be ignored. "Sheet length (n)" indicates the length of a sheet stored in the sheet storage unit (n) in the sheet conveyance direction. "Exposed length" indicates the length by which a sheet stored in each of the sheet storage units 201 to 203 is exposed from the opening portion 250. In the present exemplary embodiment, the sheets to be exposed from each of the sheet storage units 201 to 203 are exposed by the same exposed length (for example, 30 mm). The distance over which a sheet is to be actually moved by a sheet moving unit, calculated based on these parameters, is defined as "Sheet moving distance (n)." "Moving speed" indicates the speed of a sheet moving unit for moving the sheets stored in each of the sheet storage units 201 to 203 toward the opening portion 250. In the present exemplary embodiment, the moving speeds of the sheet moving units of the sheet storage units 201 to 203 are assumed to be equal. As described above, in the present exemplary embodiment, the discharge completion time is inversely proportional to the sheet length.

Discharge completion time($n$)=(Distance−Sheet length($n$)+Exposed length)/Moving speed=Sheet moving distance($n$)/Moving speed [Formula 1]

(n=Storage unit 201, Storage unit 202, or Storage unit 203)

In step S506, the controller 302 calculates the discharge completion time (n) of each of the target sheet storage units (n) and then determines a sheet storage unit having the maximum discharge completion time based on the calculation. This sheet storage unit is referred to as a sheet storage unit (max). Then, the controller 302 calculates the difference between the discharge completion time of the sheet storage unit (max) and the discharge completion time of each of the target sheet storage units. In step S507, the controller 302 instructs the storage device control unit 304 to start the movement of the sheets stored in the target sheet storage unit (max) by using the corresponding sheet moving unit. Meanwhile, in step S508, the controller 302 starts a timer. When the timer value corresponding to the difference in the discharge completion time calculated in step S506 has elapsed (YES in step S509), then in step S510, the controller 302 instructs the storage device control unit 304 to start the movement of the sheets stored in the corresponding target sheet storage unit. Then, the controller 302 repeats steps S509 to S511 until the sheet discharge is completed for all the target sheet storage units. When the sheet discharge is completed for all the target sheet storage units (YES in step S511), the processing exits this flowchart.

Figures 10A, 10B, 10C:
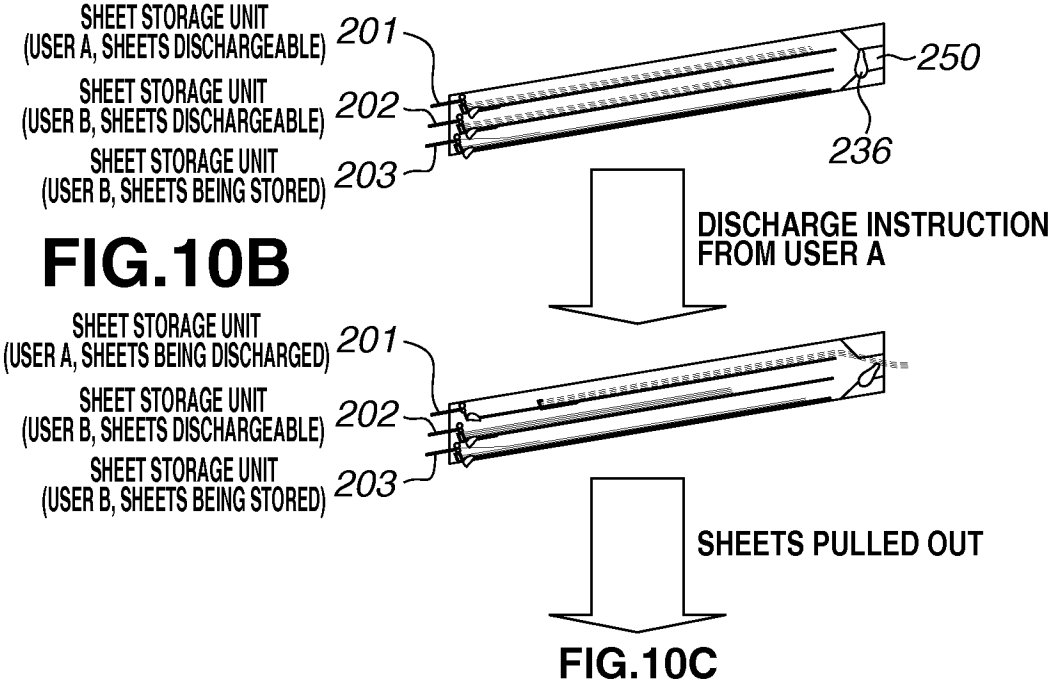

FIGS. 10A to 10G illustrate operations for exposing sheets from a plurality of sheet storage units in the following two cases: a case where control according to the present exemplary embodiment is not applied and a case where the control according to the present exemplary embodiment is applied. FIG. 10A illustrates a state where the sheet storage unit 201 stores the sheets of the user A, the sheet storage unit 202 stores the sheets of the user B, and the sheet storage unit 203 is in a process of storing sheets of the user B. In this case, the sheet storage units 201 and 202 are in the "sheets dischargeable" state, and the sheet storage unit 203 is not in the "sheets dischargeable" state. FIG. 10B illustrates a state where, after a discharge instruction is received from the user A in the state illustrated in FIG. 10A, the sheets in the sheet storage unit 201 are exposed from the opening portion 250. FIG. 10C illustrates a state where, after the exposed sheets of the user A are pulled out, the sheet storage unit 201 is empty and the sheet storage units 202 and 203 store the sheets of the user B. Referring to FIG. 10C, the sheet storage unit 203 is in the "sheets dischargeable" state.

FIGS. 10D and 10E illustrate an example of an operation in a case where the control according to the present exemplary embodiment is not applied. More specifically, when exposing the sheets from a plurality of sheet storage units, the controller 302 moves the sheets stored in the respective sheet storage units at the same timing. FIG. 10D illustrates a state where, after a discharge instruction is received from the user B in the state illustrated in FIG. 10C and then the sheet movements on the sheet storage units 202 and 203 toward the opening portion 250 are started at the same time, the sheet discharge from the sheet storage unit 203 is completed. Referring to FIG. 10D, since the length of the sheets stored in the sheet storage unit 203 is longer than the length of the sheets stored in the sheet storage unit 202, the sheet discharge from the sheet storage unit 203 is completed first. FIG. 10E illustrates a state where, after the sheet movement on the sheet storage unit 202 is continued in the state illustrated in FIG. 10D, the sheet discharge from the sheet storage unit 202 is completed. As illustrated in FIG. 10E, a sheet of the sheet storage unit 203 is partly thrusted out by the sheets of the sheet storage unit 202. This phenomenon is caused by a frictional force occurring between the sheets of the sheet storage unit 202 and the sheets of the sheet storage unit 203 when the sheets of the sheet storage unit 202 move on the sheets of the sheet storage unit 203 which have already been discharged and then stopped.

FIGS. 10F and 10G illustrate an example of an operation in a case where the control according to the present exemplary embodiment is applied. More specifically, when exposing the sheets from a plurality of sheet storage units, the controller 302 moves the sheets stored in the respective sheet storage units at different timings. FIG. 10F illustrates a state where, after reception of a discharge instruction from the user B in the state illustrated in FIG. 10C, the sheet movement on the sheet storage unit 202 having a longer discharge completion time is started first. Referring to FIG. 10F, since the length of the sheets stored in the sheet storage unit 203 is longer than the length of the sheets stored in the sheet storage unit 202, the sheet storage unit 202 has a longer discharge completion time than that of the sheet storage unit 203 based on Formula 1. A pre-contact point illustrated in FIG. 10F refers to a point just before the point where the sheets of the sheet storage unit 202 and the sheets of the sheet storage unit 203 meet and contact each other. The sheets of the sheet storage unit 203 wait for the timing calculated in consideration of the sheet length in step S509 illustrated in FIG. 9. FIG. 10G illustrates a state where, after the sheet movement on the sheet storage unit 203 is started in the state illustrated in FIG. 10F, the sheet discharges from the sheet storage unit 202 and the sheet storage unit 203 are completed. When the control according to the present exemplary embodiment is applied, the controller 302 adjusts the sheet movement timing for each of the sheet storage units 202 and 203 to enable the sheets of the sheet storage unit 202 and the sheets of the sheet storage unit 203 to be moved from the pre-contact point at the same time for the same time duration. Therefore, in comparison with the operation example illustrated in FIGS. 10D and 10E, the speed difference of the sheets of the sheet storage unit 202 relative to the sheets of the sheet storage unit 203 is 0. Therefore, the sheets of the sheet storage unit 203 are less likely to be thrusted out by the sheets of the sheet storage unit 202.

As described above, in the present exemplary embodiment, the controller 302 adjusts the sheet movement start timing for each of the sheet storage units so that the sheets of the sheet storage units move at the same speed for the same time duration from the point where the sheets of the respective sheet storage units meet and contact each other. This can reduce the influence of the thrust of sheets while the sheets stored in a plurality of sheet storage units are being exposed from the common opening portion even in a case where the sheets stored in the respective sheet storage units are different in length in the sheet conveyance direction.

In the first exemplary embodiment, the sheet movement timing for the target sheet storage unit is determined based on the difference in the discharge completion time from the maximum discharge completion time. However, the sheet movement start timing is not limited thereto, and may have a certain margin within a range in which a thrust of the sheets is permitted (hereinafter this range is referred to as a permissible sheet thrust range).

For example, the permissible sheet thrust range is defined as 5 mm. The permissible sheet thrust range may be defined as a value smaller than 5 mm or a value larger than 5 mm, depending on the usability and sheet statuses. A time duration during which a thrust of the sheets is permitted (hereinafter referred to as a permissible thrust time) will be described below with reference to FIGS. 11A and 11B.

Figures 11A, 11B:
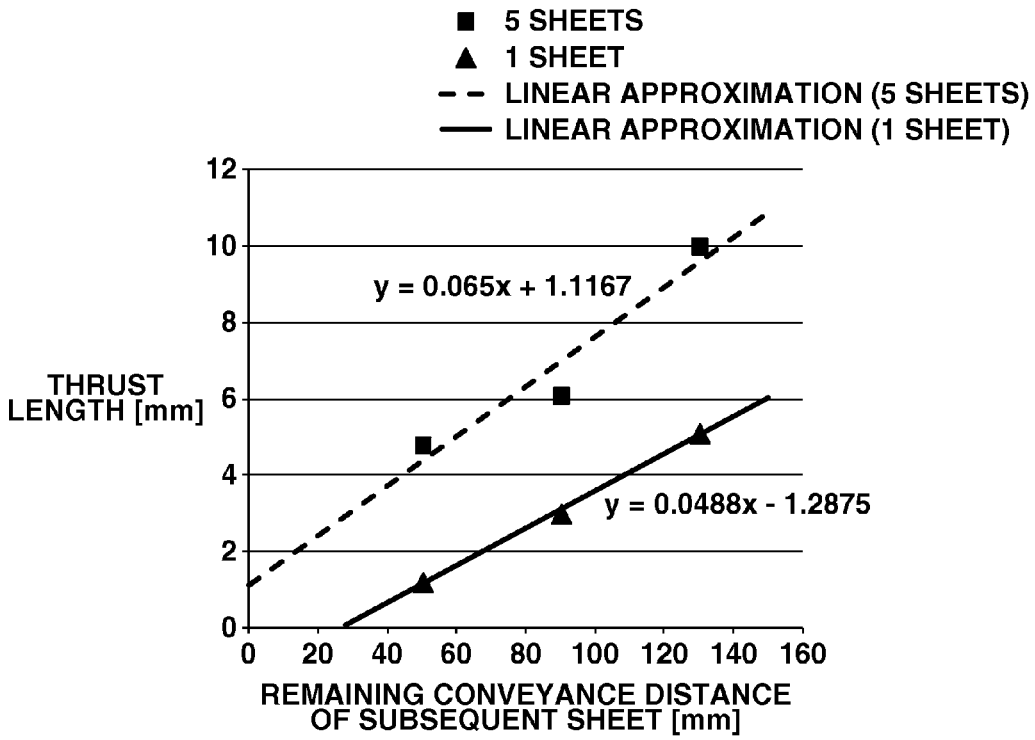
FIGS. 11A and 11B illustrate a relationship between a remaining conveyance distance of a subsequent sheet and a thrust length of a preceding sheet, depending on the number of subsequent sheets.

FIGS. 11A and 11B illustrate a relationship between the remaining conveyance distance of a subsequent sheet and the length of a preceding sheet thrusted out by the subsequent sheet when exposing an LTR-size sheet (plain paper) and a B5-size sheet (plain paper) from the opening portion 250 in a stacked manner. Since the LTR-size sheet is longer than the B5-size sheet in the sheet conveyance direction, the B5-size sheet has a longer discharge completion time than that of the LTR-size sheet. Therefore, the B5-size sheet is to be moved first. Hereinafter, the sheet (B5-size sheet) moved first is referred to as a preceding sheet, and the sheet (LTR-size sheet) moved after the preceding sheet is referred to as a subsequent sheet. The remaining conveyance distance refers to a distance over which the subsequent sheet is to be moved on the preceding sheet in a stacked manner while the preceding sheet is stopped. As understood from FIG. 11A, the thrust length of the preceding sheet increases with an increase in the remaining conveyance distance of the subsequent sheet, and further increases with an increase in the number of subsequent sheets.

The graph illustrated in FIG. 11B is acquired by plotting the measured values of the remaining conveyance distance of the subsequent sheet and the thrust length of the preceding sheet in terms of different sheet movement start timings of the LTR-size sheet after starting the movement of the B5-size sheet. Straight lines are provided for linear approximation. The solid line indicates linear approximation for one LTR-size sheet, and the dashed line indicates linear approximation for five LTR-size sheets. In the present exemplary embodiment, when the permissible sheet thrust range is 5 mm or less and the moving speed is 164 mm/s, the remaining conveyance distance of the subsequent sheet in the sheet thrust permissible range is calculated as 129 mm for one LTR-size sheet and 60 mm for five LTR-size sheets. The permissible thrust time equals the remaining conveyance distance divided by the moving speed, i.e., 0.786 [s] for one LTR-size sheet and 0.364 [s] for five LTR-size sheets. The permissible thrust time thus varies depending on the number of sheets. Therefore, the sheet movement timing may be changed according to the number of sheets to be exposed.

As described above, if the sheet movement start timing is extended up to the permissible sheet thrust range, the sheet movement may be started within a range where the timer value satisfies the following Formula 2.

$$(\text{Discharge completion time difference} - \text{Permissible thrust time}) \leq \text{Timer value} \leq (\text{Discharge completion time difference} + \text{Permissible thrust time}) \quad \text{[Formula 2]}$$

The relationships in the table illustrated in FIG. 11A and the graph illustrated in FIG. 11B are to be considered as examples according to the present exemplary embodiment, and change with the shape of the sheet storage device 200 and the length and number of sheets. These relational changes may be accommodated by measuring the relationships in advance for each image forming apparatus.

Although the permissible thrust time has been described as changing with the number of sheets with reference to FIGS. 11A and 11B, the permissible thrust time also changes with the type of sheet.

Figures 12A, 12B:
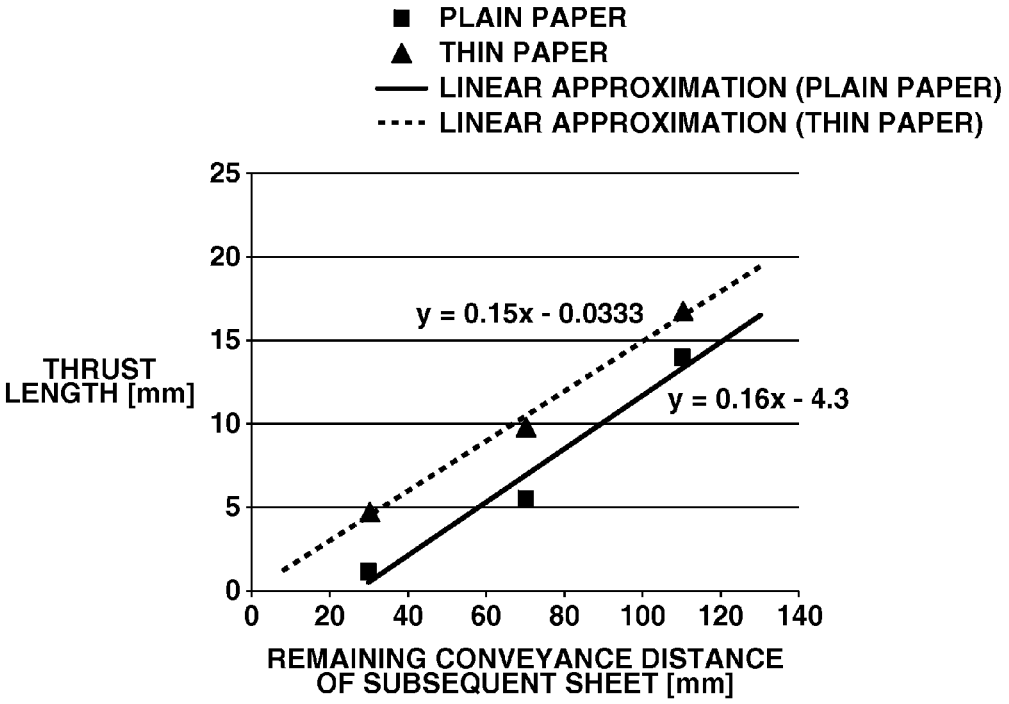
FIGS. 12A and 12B illustrate a relationship between a remaining conveyance distance of a subsequent sheet and a thrust length of a preceding sheet, depending on the type of the preceding sheet.

FIGS. 12A and 12B are respectively a table and a graph illustrating relationships between the remaining conveyance distance of the subsequent sheet and the thrust length of the preceding sheet in the following two cases: a case where plain paper and another plain paper (one sheet) are exposed from the opening portion 250 in a stacked manner and a case where thin paper and plain paper (one sheet) are exposed from the opening portion 250 in a stacked manner. In both cases, the sheets have the same length in the sheet conveyance direction and the same number of sheets are to be exposed. Referring to FIGS. 12A and 12B, the column "Plain Paper" indicates the result on a combination of plain paper as the preceding sheet and plain paper as the subsequent sheet, and the column "Thin Paper" indicates the result on a combination of thin paper as the preceding sheet and plain paper as the subsequent sheet. As understood from FIG. 12A, the thrust length of the preceding sheet increases with an increase in the remaining conveyance distance of the subsequent sheet. Further, plain paper as the preceding sheet has a shorter thrust length of the preceding sheet than thin paper as the preceding sheet.

The graph illustrated in FIG. 12B is acquired by plotting the measured values of the remaining conveyance distance of the subsequent sheet and the thrust length of the preceding sheet in terms of different movement start timings of the plain paper after starting the movement of plain paper or thin paper. Straight lines are provided for linear approximation. The solid line indicates linear approximation for plain paper as the preceding sheet, and the dashed line indicates linear approximation for thin paper as the preceding sheet. In the present exemplary embodiment, when the permissible sheet thrust range is 5 mm or less and the moving speed is 164 mm/s, the remaining conveyance distance of the subsequent sheet in the permissible sheet thrust range is calculated as 58 mm for plain paper as the preceding sheet and 34 mm for thin paper as the preceding sheet. The permissible thrust time equals the remaining conveyance distance divided by the moving speed, i.e., 0.354 [s] for plain paper as the preceding sheet and 0.205 [s] for thin paper as the preceding sheet. Thus, the permissible thrust time varies depending on the type of sheet. Therefore, the sheet movement timing may be changed according to the type of sheet to be exposed.

A second exemplary embodiment will be described using a case where the sheets are exposed from a plurality of sheet storage units in terms of different exposed lengths of the sheets exposed from the respective sheet storage units. Descriptions of main portions are similar to those according to the first exemplary embodiment. Only portions different from the first exemplary embodiment will be described below. The flowchart according to the present exemplary embodiment is similar to the flowchart illustrated in FIG. 9 according to the first exemplary embodiment, and the descriptions thereof will be omitted.

The present exemplary embodiment differs from the first exemplary embodiment in the method for calculating the discharge completion time in step S506. In the present exemplary embodiment, the discharge completion time (n) of the target sheet storage unit (n) is calculated based on the following Formula 3. [Formula 3] differs from [Formula 1] in that "Exposed length" is different for each sheet storage unit (n).

$$\text{Discharge completion time}(n) = (\text{Distance} - \text{Sheet length}(n) + \text{Exposed length}(n))/\text{Moving speed} \quad \text{[Formula 3]}$$

(n=Storage unit 201, Storage unit 202, or Storage unit 203)

In step S506, the controller 302 calculates the discharge completion time (n) of each of the target sheet storage units (n), and then determines a sheet storage unit having the maximum discharge completion time based on the calculation. This sheet storage unit is referred to as a sheet storage unit (max). Then, the controller 302 calculates the difference between the discharge completion time of the sheet storage unit (max) and the discharge completion time of each of the target sheet storage units.

FIGS. 13A to 13E illustrate operations for exposing sheets from a plurality of sheet storage units in the following two cases: a case where control according to the present exemplary embodiment is not applied and a case where the control according to the present exemplary embodiment is applied. FIG. 13A illustrates a state where each of the sheet storage units 202 and 203 stores the sheets of the user B. Referring to FIG. 13A, the sheet storage unit 202 stores the sheets for job number 1 and the sheet storage unit 203 stores the sheets for job number 2. When exposing the sheets of the sheet storage unit 202 and the sheets of the sheet storage unit 203 from the opening portion 250 in a stacked manner, if the exposed lengths of the respective sheets are equal to each other, the user cannot distinguish between the sheets of the sheet storage unit 202 and the sheets of the sheet storage unit 203. In this case, after the user takes out the sheets from the opening portion 250, the user needs to take time to separate the sheets for job number 1 and the sheets for job number 2. In the present exemplary embodiment, therefore, the exposed length is differentiated between the sheets of the sheet storage unit 202 and the sheets of the sheet storage unit 203, allowing the user to distinguish between the two sheet bundles.

FIGS. 13B and 13C illustrate an example of an operation in a case where the control according to the present exemplary embodiment is not applied. More specifically, when exposing the sheets from a plurality of sheet storage units, the controller 302 moves the sheets stored in the respective sheet storage units at the same timing. FIG. 13B illustrates a state where, after a discharge instruction is received from the user B in the state illustrated in FIG. 13A and the sheet movements on the sheet storage units 202 and 203 toward the opening portion 250 are started at the same time, the sheet discharge from the sheet storage unit 202 is completed. FIG. 13C illustrates a state where, after the sheet movement on the sheet storage unit 203 is continued in the state illustrated in FIG. 13B, the sheet discharge from the sheet storage unit 203 is completed with an exposed length different from the exposed length of the sheets of the sheet storage unit 202. As illustrated in FIG. 13C, a sheet of the sheet storage unit 202 is partly thrusted out by the sheets of the sheet storage unit 203. This phenomenon is caused by a frictional force occurring between the sheets of the sheet storage unit 202 and the sheets of the sheet storage unit 203 when the sheets of the sheet storage unit 203 moves under the sheets of the sheet storage unit 202 which have already been discharged and then stopped.

On the other hand, FIGS. 13D and 13E illustrate an example of an operation in a case where the control according to the present exemplary embodiment is applied. More specifically, when exposing the sheets from a plurality of sheet storage units, the controller 302 moves the sheets stored in the respective sheet storage units at different timings. FIG. 13D illustrates a state where, after reception of a discharge instruction from the user B in the state illustrated in FIG. 13A, the sheet movement on the sheet storage unit 203 having a longer discharge completion time is started first. The sheets of the sheet storage unit 202 wait for the timing calculated in consideration of the difference in the sheet length and the exposed length in step S509 illustrated in FIG. 9. FIG. 13E illustrates a state where, after the sheet movement on the sheet storage unit 202 is started in the state illustrated in FIG. 13D, the sheet discharges from the sheet storage unit 202 and the sheet storage unit 203 are completed. When the control according to the present exemplary embodiment is applied, the controller 302 adjusts the sheet movement timing for each of the sheet storage unit 202 and the sheet storage unit 203 to enable the sheets of the sheet storage unit 202 and the sheets of the sheet storage unit 203 to be moved from the pre-contact point at the same time for the same time duration. Therefore, in comparison with the operation example illustrated in FIGS. 13B and 13C, the speed difference of the sheets of the sheet storage unit 203 relative to the sheets of the sheet storage unit 202 is 0. Therefore, the sheets of the sheet storage unit 202 are less likely to be thrusted out by the sheets of the sheet storage unit 203.

As described above, in the present exemplary embodiment, the controller 302 adjusts the sheet movement start timing for each of the sheet storage units so that the sheets of the respective sheet storage units move at the same speed for the same time duration from the point where the sheets of the respective sheet storage units meet and contact each other. This can reduce the influence of the thrust of sheets while the sheets stored in a plurality of sheet storage units are being exposed from the common opening portion even in a case where the sheets stored in the respective sheet storage units are to be exposed from the opening portion by different lengths.

Similar to the first exemplary embodiment, also in the second exemplary embodiment, the sheet movement start timing may have a certain margin within the permissible sheet thrust range. Although the permissible sheet thrust range is set to 5 mm or less in the first exemplary embodiment, it may be set based on the difference between the exposed lengths for the respective sheet storage units in the present exemplary embodiment. This ensures the boundary of the exposed lengths even if a thrust occurs, the user can distinguish between the sheet bundles. For example, when the difference in exposed length between two sets of sheets is 6 mm, a shift of the exposed length of either one set of sheets by 3 mm or more makes it hard for the user to distinguish between the two sets of sheets. Therefore, a half of the difference between the exposed lengths may be set as the permissible sheet thrust range.

A third exemplary embodiment will be described using a configuration in which each of the sheet storage units 201 to 203 has a different distance from the upstream position to the opening portion 250. Descriptions of main portions are similar to those according to the first exemplary embodiment. Only portions different from the first exemplary embodiment will be described below. The flowchart according to the present exemplary embodiment is similar to the flowchart illustrated in FIG. 9 according to the first exemplary embodiment, and the descriptions thereof will be omitted.

The present exemplary embodiment differs from the first exemplary embodiment in the method for calculating the discharge completion time in step S506. In the present exemplary embodiment, the discharge completion time (n) of each of the target sheet storage units (n) is calculated based on the following Formula 4. [Formula 4] differs from [Formula 1] in that "Distance" is different for each of the sheet storage units (n).

$$\text{Discharge completion time}(n)=(\text{Distance}(n)-\text{Sheet length}(n)+\text{Exposed length})/\text{Moving speed} \quad \text{[Formula 4]}$$

(n=Storage unit 201, Storage unit 202, or Storage unit 203)

In step S506, the controller 302 calculates the discharge completion time (n) of each of the target sheet storage units (n), and then determines a sheet storage unit having the maximum discharge completion time based on the calculation. This sheet storage unit is referred to as a sheet storage unit (max). Then, the controller 302 calculates the difference between the discharge completion time of the sheet storage unit (max) and the discharge completion time of each of the target sheet storage units.

FIGS. 14A to 14F illustrate operations in a configuration where "Distance" is different for each of the sheet storage units (n) in the following two cases: a case where control according to the present exemplary embodiment is not applied and a case where the control is applied. FIG. 14A illustrates a state where each of the sheet storage units 201 and 202 stores the sheets of the user A. Referring to FIG. 14A, since Distance (1) of the sheet storage unit 201 is L1+L2+L3 and Distance (2) of the sheet storage unit 202 is L1+L2'+L3', the relationship "Distance (1)>Distance (2)" is satisfied. Further, in the present exemplary embodiment, the sheets stored in the sheet storage unit 201 and the sheets stored in the sheet storage unit 202 are assumed to have the same sheet length.

FIGS. 14B and 14C illustrate an example of an operation in a case where the control according to the present exemplary embodiment is not applied. More specifically, when exposing the sheets from a plurality of sheet storage units, the controller 302 moves the sheets stored in the respective sheet storage units at the same timing. FIG. 14B illustrates a state where, after a discharge instruction is received from the user A in the state illustrated in FIG. 14A and the sheet movements on the sheet storage units 201 and 202 toward the opening portion 250 are started at the same time, the sheet discharge from the sheet storage unit 202 is completed. FIG. 14C illustrates a state where, after the sheet movement on the sheet storage unit 201 is continued in the state illustrated in FIG. 14B, the sheet discharge from the sheet storage unit 201 is completed. As illustrated in FIG. 14C, a sheet of the sheet storage unit 202 is partly thrusted out by the sheets of the sheet storage unit 201. This phenomenon is caused by a frictional force occurring between the sheets of the sheet storage unit 201 and the sheets of the sheet storage unit 202 when the sheets of the sheet storage unit 201 move on the sheets of the sheet storage unit 202 which have already been discharged and then stopped.

On the other hand, FIGS. 14D and 14E illustrate an example of an operation in a case where the control according to the present exemplary embodiment is applied. More specifically, when exposing the sheets from a plurality of sheet storage units, the controller 302 moves the sheets stored in the respective sheet storage units at different timings. FIG. 14D illustrates a state where, after reception of a discharge instruction from the user A in the state illustrated in FIG. 14A, the sheet movement on the sheet storage unit 201 having a longer discharge completion time is started first. The sheets of the sheet storage unit 202 wait for the timing calculated in consideration of the difference in the sheet length and the distance in step S509 illustrated in FIG. 9. FIG. 14E illustrates a state where, after the sheet movement on the sheet storage unit 202 is started in the state illustrated in FIG. 14D, the sheet discharges from the sheet storage unit 202 and from the sheet storage unit 203 are completed. When the control according to the present exemplary embodiment is applied, the controller 302 adjusts the sheet movement timing for each of the sheet storage units 201 and 202 to enable the sheets of the sheet storage unit 201 and the sheets of the sheet storage unit 202 to be moved from the pre-contact point at the same time for the same time duration. Therefore, in comparison with the operation example illustrated in FIGS. 14B and 14C, the speed difference of the sheets of the sheet storage unit 202 relative to the sheets of the sheet storage unit 201 is 0. Therefore, the sheets of the sheet storage unit 202 are less likely to be thrusted out by the sheets of the sheet storage unit 201.

As described above, in the present exemplary embodiment, the controller 302 adjusts the sheet movement start timing for each of the sheet storage units so that the sheets of the respective sheet storage units move at the same speed for the same time duration from the point where the sheets of the respective sheet storage units meet and contact each other. This can reduce the influence of the thrust of sheets while the sheets stored in a plurality of sheet storage units are being exposed from the common opening portion even in a case where each of the sheet storage units has a different distance from the upstream position to the opening portion 250.

Unlike the first to the third exemplary embodiments, in the fourth exemplary embodiment, the controller 302 adjusts the sheet moving speed for each of the sheet storage units without adjusting the sheet movement start timing for each of the sheet storage units. The configuration of the image forming apparatus 100 is similar to that according to the first exemplary embodiment. Only portions different from the first exemplary embodiment will be described below.

Figure 15A:
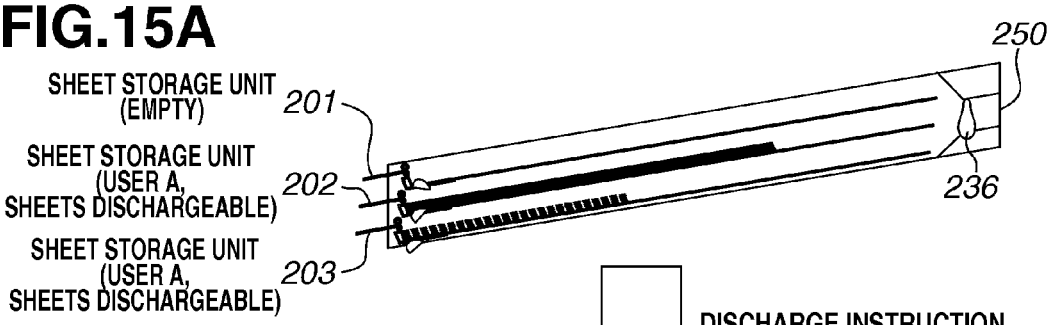
FIGS. 15A to 15D illustrate examples of sheet discharge operations according to a fourth exemplary embodiment of the present invention.
Figure 15B:
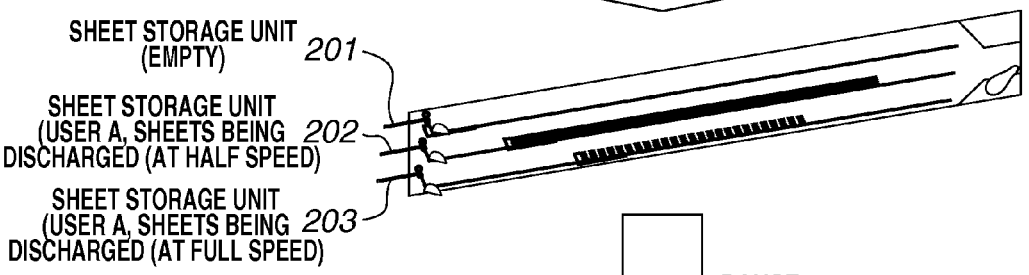
Figure 15C:
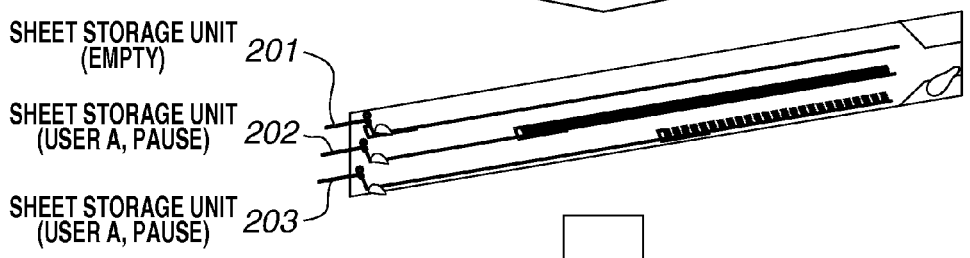
Figure 15D:
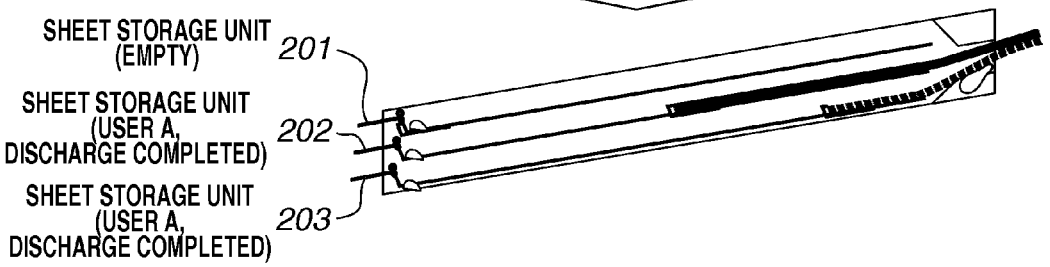

FIGS. 15A to 15D illustrate examples of operations according to the present exemplary embodiment. FIG. 15A illustrates a state where each of the sheet storage unit 202 and the sheet storage unit 203 stores the sheets of the user A. The length of the sheets stored in the sheet storage unit 202 in the sheet conveyance direction is longer than the length of the sheets stored in the sheet storage unit 203 in the sheet conveyance direction. FIG. 15B illustrates a state where, after a discharge instruction is received from the user A in the state illustrated in FIG. 15A, the sheets are being moved from the sheet storage unit 202 at a half speed and the sheets are being moved from the sheet storage unit 203 at a full speed. In the present exemplary embodiment, two sets of sheets are being moved toward the opening portion 250 at the same timing. The sheet moving speed is determined by the sheet moving distance based on [Formula 1]. A high sheet moving speed is set for a sheet storage unit having a long sheet moving distance, and a low sheet moving speed is set for a sheet storage unit having a short sheet moving distance. More specifically, the sheet moving speed is proportional to the sheet moving distance. FIG. 15C illustrates a state where, after the sheet movement is continued in the state illustrated in FIG. 15B, the sheets are being paused before the sheets meet and contact each other. More specifically, each of the sheet bundles is stopped when arriving at the pre-contact point according to the first exemplary embodiment. FIG. 15D illustrates a state where, after the sheet movements are restarted with a zero speed difference between the sheet storage unit 202 and the sheet storage unit 203 in the state illustrated in FIG. 15C, the sheet discharges are completed.

As described above, in the present exemplary embodiment, the controller 302 adjusts the sheet moving speed for each of the sheet storage units so that the sheets of the respective sheet storage units move at the same speed for the same time duration from the point where the sheets of the respective sheet storage units meet and contact each other. This can reduce the influence of the thrust of sheets while the sheets stored in a plurality of sheet storage units are being exposed from the common opening portion even in a case where the sheets stored in the respective sheet storage units are different in length in the sheet conveyance direction.

Although, in the fourth exemplary embodiment, the sheets are paused in FIG. 15C, the operation is not limited thereto. The sheet speed difference from the pre-contact point may be reduced to 0 by changing the speeds halfway without pausing the sheet movements. Further, it is not necessary to reduce the sheet speed difference from the pre-contact point to 0, and it is sufficient to reduce the speed difference in the permissible sheet thrust range. In this case, as described in the first exemplary embodiment, the speed difference may be adjusted depending on the number of sheets and the type of sheet.

Although the fourth exemplary embodiment has been described, taking as an example the case where the sheets stored in the respective sheet storage units are different in length in the sheet conveyance direction, the present invention is also applicable to a case where the exposed length and the distance are different for each sheet storage unit as in the second and the third exemplary embodiments. Likewise, also in these cases, it is necessary to set the sheet moving speed according to the calculated sheet moving distance (n).

Although, in the above-described exemplary embodiments, the controller 302 adjusts the sheet movement start timing or the sheet moving speed for each sheet storage unit to align the leading edges of the sheets before they meet and contact each other, the operation is not limited thereto. The sheet storage device 200 may be configured to, even with different sheet movement start timings or different sheet moving speeds, pause the sheets of each sheet storage unit before the pre-contact point and, when the leading edge positions of the sheets are aligned, move the sheets again.

In the above-described exemplary embodiments, since the sheet moving units of the respective sheet storage units are provided with separate actuators, driving these actuators at the same time can expose the sheets stored in the plurality of the sheet storage units in a stacked manner. On the other hand, by providing actuators less in number than the number of sheet storage units and providing a drive transfer switching unit such as a clutch (not illustrated), the sheet storage device 200 may be configured to selectively move the plurality of sheet moving units by using one actuator.

In the above-described exemplary embodiments, the memory 305 is provided in the controller 302. However, the memory 305 may be provided in the engine control unit 303 or the storage device control unit 304, or may be independently provided in the image forming apparatus control unit 301.

Although, in the above-described exemplary embodiments, the engine control unit 303 and the storage device control unit 304 are separately configured, only the engine control unit 303 may be configured. In this case, the engine control unit 303 may control both the conveyance unit 105 and the sheet storage device 200.

Although, in the above-described exemplary embodiments, sheet conveyance paths meet on the downstream side of each sheet storage unit and only one opening portion is provided, a plurality of opening portions may be separately provided. In this case, when exposing the sheets of a plurality of sheet storage units in a stacked manner from any one of the plurality of opening portions, the operations according to the above-described exemplary embodiments are applicable.

Although, in the above-described exemplary embodiments, three sheet storage units are provided, the number of sheet storage units is not limited thereto. The number of sheet storage units may be set according to the environment where the apparatus body is used, the number of users who share the apparatus body, and the specifications of the apparatus body.

Although, in the above-described exemplary embodiments, the sheet storage device 200 and the image forming apparatus 100 have been described to be integrally configured. Instead of this configuration, the sheet storage device 200 may be detachably attached or simply attached to the image forming apparatus 100. In that case, a control unit provided in the image forming apparatus 100 may control operations of the sheet storage device 200. Further, the sheet storage device 200 may include an independent control unit for communicating with the control unit included in the image forming apparatus 100 to control operations of the sheet storage device 200.

Although, in the above-described exemplary embodiments, a laser beam printer has been described as an example of an image forming apparatus, an image forming apparatus according to the exemplary embodiments of the present invention is not limited thereto, and may be a printer having other printing process, such as an ink-jet printer, or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-207331, filed Oct. 8, 2014, which is hereby incorporated by reference herein in its entirety.

What is claimed is:

1. An image forming apparatus comprising:

an apparatus body in which an opening portion is formed;

an image forming unit configured to form an image on a sheet;

a plurality of sheet storage units, wherein each sheet storage unit is configured to store, inside the apparatus body, the sheet with the image formed thereon by the image forming unit;

a sheet moving unit provided in each of the plurality of sheet storage units, and configured to move the sheet stored therein and then stop the sheet in an exposed state where the sheet is partly exposed, from the opening portion, to an outside of the apparatus body; and a control unit configured to control each sheet moving unit, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, when a moving distance of the first sheet to bring the first sheet into the exposed state and a moving distance of the second sheet to bring the second sheet into the exposed state are different from each other, the control unit controls sheet moving units provided in the first sheet storage unit and the second sheet storage unit to change a movement start timing of the first sheet relative to a movement start timing of the second sheet or to change a moving speed of the first sheet relative to a moving speed of the second sheet, based on the moving distance of the first sheet and the moving distance of the second sheet.

2. The image forming apparatus according to claim 1, wherein, in a case where the moving distance of the first sheet is longer than the moving distance of the second sheet, the control unit makes the movement start timing of the first sheet earlier than the movement start timing of the second sheet.

3. The image forming apparatus according to claim 1, wherein, in a case where the moving distance of the first sheet is longer than the moving distance of the second sheet, the control unit makes the moving speed of the first sheet faster than the moving speed of the second sheet.

4. The image forming apparatus according to claim 1, wherein the control unit changes the movement start timing of the first sheet relative to the movement start timing of the second sheet or changes the moving speed of the first sheet relative to the moving speed of the second sheet, based on a length of the first sheet in a sheet conveyance direction and a length of the second sheet in the sheet conveyance direction.

5. The image forming apparatus according to claim 1, wherein the control unit changes the movement start timing of the first sheet relative to the movement start timing of the second sheet or changes the moving speed of the first sheet relative to the moving speed of the second sheet, based on a length by which the first sheet is exposed from the opening portion and a length by which the second sheet is exposed from the opening portion.

6. The image forming apparatus according to claim 1, wherein the control unit changes the movement start timing of the first sheet relative to the movement start timing of the second sheet or changes the moving speed of the first sheet relative to the moving speed of the second sheet, based on a length of the first sheet storage unit in a sheet conveyance direction and a length of the second sheet storage unit in the sheet conveyance direction.

7. The image forming apparatus according to claim 1, wherein the control unit controls the sheet moving units provided in the first sheet storage unit and the second sheet storage unit to move the first and the second sheets at a same speed for a same time duration at least from a time when the first and the second sheets contact each other, and then to stop the first and the second sheets in the exposed state.

8. The image forming apparatus according to claim 1, wherein the control unit controls the sheet moving unit provided in the first sheet storage unit and the second sheet storage unit to move the first and the second sheets at different speeds so that a length of a thrust of the second sheet by the first sheet or a length of a thrust of the first sheet by the second sheet caused by a difference in moving speed between the first and the second sheets falls within a predetermined range at least from a time when the first and the second sheets contact each other, and then to stop the first and the second sheets in the exposed state.

9. The image forming apparatus according to claim 1, wherein the control unit controls the sheet moving units provided in the first sheet storage unit and the second sheet storage unit to move the first and the second sheets for different time durations so that a length of a thrust of the second sheet by the first sheet or a length of a thrust of the first sheet by the second sheet caused by a difference in moving time duration between the first and the second sheets falls within a predetermined range at least from a time when the first and the second sheets contact each other, and then to stop the first and the second sheets in the exposed state.

10. An image forming apparatus comprising:

an apparatus body in which an opening portion is formed;

an image forming unit configured to form an image on a sheet;

a plurality of sheet storage units, wherein each sheet storage unit is configured to store, inside the apparatus body, the sheet with the image formed thereon by the image forming unit;

a sheet moving unit provided in each of the plurality of sheet storage units, and configured to move the sheet stored therein and then stop the sheet in an exposed state where the sheet is partly exposed, from the opening portion, to an outside of the apparatus body; and a control unit configured to control each sheet moving unit, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, when a moving distance of the first sheet to bring the first sheet into the exposed state and a moving distance of the second sheet to bring the second sheet into the exposed state are different from each other, the control init controls sheet moving units provided in the first sheet storage unit and the second sheet unit to move the first and the second sheets, to pause the first and the second sheets at respective positions corresponding to lengths of the first and the second sheets to be exposed from the opening portion before the first and the second sheets contact each other, and then to resume moving the first and the second sheets.

11. The image forming apparatus according to claim 10, wherein the control unit controls the sheet moving units provided in the first sheet storage unit and the second sheet storage unit to move the first and the second sheets at a same speed for a same time duration at least from a time when the first and the second sheets contact each other, and then to stop the first and the second sheets in the exposed state.

12. The image forming apparatus according to claim 10, wherein the control unit controls the sheet moving units provided in the first sheet storage unit and the second sheet storage unit to move the first and the second sheets at different speeds so that a length of a thrust of the second sheet by the first sheet or a length of a thrust of the first sheet by the second sheet caused by a difference in moving speed between the first and the second sheets falls within a predetermined range at least from a time when the first and the second sheets contact each other, and then to stop the first and the second sheets in the exposed state.

13. The image forming apparatus according to claim 10, wherein the control unit controls the sheet moving units provided in the first sheet storage unit and the second sheet storage unit to move the first and the second sheets for different time durations so that a length of a thrust of the second sheet by the first sheet or a length of a thrust of the first sheet by the second sheet caused by a difference in moving time duration between the first and the second sheets falls within a predetermined range at least from a time when the first and the second sheets contact each other, and then to stop the first and the second sheets in the exposed state.

14. An image forming apparatus comprising:

an apparatus body in which an opening portion is formed;

an image forming unit configured to form an image on a sheet;

a plurality of sheet storage units, wherein each sheet storage unit is configured to store, inside the apparatus body, the sheet with the image formed thereon by the image forming unit; and a sheet moving unit provided in each of the plurality of sheet storage units, and configured to move the sheet stored therein and then stop the sheet in an exposed state where the sheet is partly exposed, from the opening portion, to an outside of the apparatus body; and a control unit configured to control each sheet moving unit, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, the control unit controls the sheet moving units provided in the first sheet storage unit and the second sheet storage unit to move the first and the second sheets so that a moving speed of the second sheet relative to a moving speed of the first sheet becomes approximately zero in a period from when the first and the second sheets contact each other until when the first and the second sheets are stopped.

15. The image forming apparatus according to claim 14, wherein the control unit controls the sheet moving units provided in the first sheet storage unit and the second sheet storage unit to move the first and the second sheets at a same speed for a same time duration at least from a time when the first and the second sheets contact each other, and then to stop the first and the second sheets in the exposed state.

16. The image forming apparatus according to claim 14, wherein the control unit controls the sheet moving units provided in the first sheet storage unit and the second sheet storage unit to move the first and the second sheets at different speeds so that a length of a thrust of the second sheet by the first sheet or a length of a thrust of the first sheet by the second sheet caused by a difference in moving speed between the first and the second sheets falls within a predetermined range at least from a time when the first and the second sheets contact each other, and then to stop the first and the second sheets in the exposed state.

17. The image forming apparatus according to claim 14, wherein the control unit controls the sheet moving units provided in the first sheet storage unit and the second sheet storage unit to move the first and the second sheets for different time durations so that a length of a thrust of the second sheet by the first sheet or a length of a thrust of the first sheet by the second sheet caused by a difference in moving time duration between the first and the second sheets falls within a predetermined range at least from a time when the first and the second sheets contact each other, and then to stop the first and the second sheets in the exposed state.

18. A sheet storage device attachable to an image forming apparatus for forming an image on a sheet, the sheet storage device comprising:

an apparatus body in which an opening portion is formed;

a plurality of sheet storage units, wherein each sheet storage unit is configured to store, inside the apparatus body, the sheet with the image formed thereon;

a sheet moving unit provided in each of the plurality of sheet storage units, and configured to move the sheet stored therein and then stop the sheet in an exposed state where the sheet is partly exposed, from the opening portion, to an outside of the apparatus body; and a controlled unit configured to control each sheet moving unit.

wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, when a moving distance of the first sheet to bring the first sheet into the exposed state and a moving distance of the second sheet to bring the second sheet into the exposed state are different from each other, the control unit controls sheet moving units provided in the first sheet storage unit and the second sheet storage unit to change a movement start timing of the first sheet relative to a movement start timing of the second sheet or to change a moving speed of the first sheet relative to a moving speed of the second sheet, based on the moving distance of the first sheet and the moving distance of the second sheet.

19. A sheet storage device attachable to an image forming apparatus for forming an image on a sheet, the sheet storage device comprising:

an apparatus body in which an opening portion is formed;

a plurality of sheet storage units, wherein each sheet storage unit is configured to store, inside the apparatus body, the sheet with the image formed thereon;

a sheet moving unit provided in each of the plurality of sheet storage units, and configured to move the sheet stored therein and then stop the sheet in an exposed state where the sheet is partly exposed, from the opening portion, to an outside of the apparatus body; and a control unit configured to control each sheet moving unit, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, when a moving distance of the first sheet to bring the first sheet into the exposed state and a moving distance of the second sheet to bring the second sheet into the exposed state are different from each other, the control unit controls sheet moving units provided in the first sheet storage unit and the second sheet storage unit to move the first and the second sheets, to pause the first and the second sheets at respective positions corresponding to lengths of the first and the second sheets to be exposed from the opening portion before the first and the second sheets contact each other, and then to resume moving the first and the second sheets.

20. A sheet storage device attachable to an image forming apparatus for forming an image on a sheet, the sheet storage device comprising:

an apparatus body in which an opening portion is formed;

a plurality of sheet storage units, wherein each sheet storage unit is configured to store, inside the apparatus body, the sheet with the image formed thereon;

a sheet moving unit provided in each of the plurality of sheet storage units, and configured to move the sheet stored therein and then stop the sheet in an exposed state where the sheet is partly exposed, from the opening portion, to an outside of the apparatus body; and a control unit configured to control each sheet moving unit, wherein, in a case where a first sheet, stored in a first sheet storage unit among the plurality of sheet storage units, and a second sheet, stored in a second sheet storage unit different from the first sheet storage unit among the plurality of sheet storage units, are brought into contact with each other and then exposed from the opening portion to the outside of the apparatus body in the exposed state, the control unit controls the sheet moving units provided in the first sheet storage unit and the second sheet storage unit to move the first and the second sheets so that a moving speed of the second sheet relative to a moving speed of the first sheet becomes approximately zero in a period from when the first and the second sheets contact each other until when the first and the second sheets are stopped.

* * * * *